US007360341B2

(12) United States Patent
Jackson et al.

(10) Patent No.: US 7,360,341 B2
(45) Date of Patent: Apr. 22, 2008

(54) SLAB SUPPORT TRUSS SYSTEM

(75) Inventors: Barry W. Jackson, 420 Regency Drive, Mississauga, Ontario (CA) L5C 4K4; George W. Jackson, Mississauga (CA)

(73) Assignee: Barry W. Jackson, Mississauga (CA)

( * ) Notice: Subject to any disclaimer, the term of this patent is extended or adjusted under 35 U.S.C. 154(b) by 138 days.

(21) Appl. No.: 10/660,528

(22) Filed: Sep. 12, 2003

(65) Prior Publication Data

US 2004/0118065 A1 Jun. 24, 2004

Related U.S. Application Data

(60) Provisional application No. 60/443,553, filed on Jan. 30, 2003, provisional application No. 60/444,180, filed on Feb. 3, 2003.

(30) Foreign Application Priority Data

Sep. 13, 2002 (CA) ..... 2403074

(51) Int. Cl.
*E04C 3/10* (2006.01)
*E04C 3/32* (2006.01)

(52) U.S. Cl. ..... 52/223.12; 52/645; 52/731.1

(58) Field of Classification Search ..... 52/639, 52/640, 644, 690, 691, 692, 694, 695, 223.1, 52/731.7, 729.2, 223.8, 223.9, 223.11, 223.12, 52/693

See application file for complete search history.

(56) References Cited

U.S. PATENT DOCUMENTS 252,929 A * 1/1882 Carter ..... 52/640
275,832 A * 4/1883 Lockwood ..... 52/291
435,156 A * 5/1890 Schmemann ..... 52/644
932,118 A * 8/1909 Gerhardt et al. ..... 52/640
981,966 A * 1/1911 Ambrozy ..... 5/236.1
1,167,692 A * 1/1916 Hinton ..... 5/236.1
1,233,743 A * 7/1917 Arndt ..... 52/640
1,813,338 A * 7/1931 Botel et al. ..... 52/223.12
1,840,745 A * 1/1932 Shoaf ..... 52/644

(Continued)

*Primary Examiner*—M. Safavi
(74) *Attorney, Agent, or Firm*—Bereskin & Parr

(57) ABSTRACT

A column mounted shoring bracket has a support sub-assembly attached to a column or other supporting surface, a jack sub-assembly attached to the support and a head sub-assembly attached to a part of the jack that varies in height relative to the support. The head has a head base that supports one or more rollers for moving a form. The head also has a supporting plate for supporting the form. The supporting plate is connected to the head base so that it may be slid upwards and fixed in a position where the top of the supporting plate is above the top of the rollers, for example to carry the weight of a slab being built, or slid downwards so that the top of the supporting plate is below the top of the rollers which do not have to carry the weight of the slab being built. The angular position of the rollers may be aligned with an external reference such as the side of a column, a wall, or a jig. The bracket is adapted for use with parts of forms that may be made or assembled in or adjusted between a set of widths within a range that differ from each other by a selected increment. The forms include structures for spanning between shoring brackets or other supports that can be pre-cambered so as to have acceptable deflection when loaded.

10 Claims, 24 Drawing Sheets

U.S. PATENT DOCUMENTS

| | | | | | |
|---|---|---|---|---|---|
| 1,880,000 | A | * | 9/1932 | Wallen | 52/694 |
| 2,183,015 | A | * | 12/1939 | Foulds | 52/640 |
| 2,315,687 | A | * | 4/1943 | Burke | 52/694 |
| 2,653,553 | A | * | 9/1953 | Jacobs | 52/639 |
| 2,793,720 | A | * | 5/1957 | Hawes | 52/640 |
| 2,985,264 | A | * | 5/1961 | Leonard, Jr. | 52/223.12 |
| 3,172,634 | A | | 3/1965 | Squire | |
| 3,362,117 | A | * | 1/1968 | Van Raden | 52/640 |
| 3,504,879 | A | | 4/1970 | Strickland | |
| 3,771,753 | A | | 11/1973 | Wilbur et al. | |
| 3,776,499 | A | | 12/1973 | Turner et al. | |
| 3,815,858 | A | | 6/1974 | Mocny et al. | |
| 3,826,057 | A | * | 7/1974 | Franklin | 52/693 |
| 3,826,459 | A | | 7/1974 | Warren | |
| 3,863,877 | A | | 2/1975 | Gregory | |
| 3,863,896 | A | | 2/1975 | Hope et al. | |
| 3,967,806 | A | | 7/1976 | Strickland et al. | |
| 3,994,036 | A | * | 11/1976 | Fisher | 52/640 |
| 4,102,108 | A | * | 7/1978 | Cody | 52/693 |
| 4,106,256 | A | * | 8/1978 | Cody | 52/694 |
| 4,546,591 | A | * | 10/1985 | Beltz | 52/693 |
| 4,704,830 | A | * | 11/1987 | Magadini | 52/729.1 |
| 5,326,065 | A | | 7/1994 | Jackson | |
| 6,243,996 | B1 | * | 6/2001 | Oliver et al. | 52/693 |

* cited by examiner

SLAB SUPPORT TRUSS SYSTEM

This is a non-provisional of U.S. provisional application No. 60/444,180 filed Feb. 3, 2003 and a non-provisional of U.S. provisional application No. 60/443,553 filed Jan. 30, 2003 and claims priority from Canadian patent application number 2,403,074 filed Sep. 13, 2003. The entirety of all of the documents mentioned above is hereby incorporated into this document by this reference to them.

FIELD OF THE INVENTION

This invention relates to systems of brackets hung (ie. mounted) on columns or walls for shoring or slab support and to components, for example trusses, used to span between such brackets, used as part of shoring systems, for example those commonly known as column hung systems or column hung slab support and shoring systems.

BACKGROUND OF THE INVENTION

Column hung shoring systems typically include a number of brackets mounted to the columns or walls of a building or other structures being built. A temporary slab support structure is then built between the brackets. This type of system is used to carry the load of a slab to be poured on the columns or walls, thus eliminating the need to re-shore under a relatively new slab and floors below which allows work to be done on these floors to speed up construction. For example, beams can be laid across two parallel rows of brackets and joists added between the beams. Such a structure can then be used, for example, to support a form for pouring a concrete floor or as scaffolding to facilitate other types of construction. The brackets and other temporary structure are later removed and the brackets may be re-used. The space under the floor is kept open, enabling workers easy access for other work.

Examples of column hung shoring brackets and shoring systems are described in U.S. Pat. No. 3,815,858 (issued Jun. 11, 1974 to Mocny et. al.), U.S. Pat. No. 3,863,877 (issued Jun. 1, 1973 to Gregory) and U.S. Pat. No. 3,967,806 (issued Jul. 6, 1976 to Strickland et. al.). A foot or top plate assembly for a shoring structure or tower is described in U.S. Pat. No. 5,326,065 (issued Jul. 5, 1994 to Jackson). The entire disclosure of all of these patents is incorporated herein by this reference to them.

SUMMARY OF INVENTION

The inventor has noticed several deficiencies in prior art column or wall mounted shoring brackets and systems. For example, prior art shoring brackets are heavy or awkward which makes them difficult to install or strip. The rollers of prior art shoring brackets are also difficult to align with the rollers of other shoring brackets or with the direction in which a pre-made form will be rolled onto or off of the brackets. As a result, their rollers often bind and work against each other. Prior art shoring brackets are also not well integrated into shoring systems and require excess amounts of custom installation work, particularly in relation to the shoring structures placed between the brackets. Further, the structures erected between brackets in prior art column or wall mounted shoring systems often deflect excessively when spanning large distances (for example 20' or more). It is an object of the invention to improve on one or more of these or other deficiencies of the prior art. Another object of the invention is to provide a shoring bracket consisting of a small number of easily handled sub-assemblies. Another object of the invention is to provide a shoring bracket or shoring bracket head sub-assembly wherein the relative elevation of one or more rollers and a supporting plate can be varied to transfer a form or other structure easily between the rollers and supporting plate. Another object of the invention is to provide a shoring bracket or shoring bracket head with rollers that can be aligned quickly with an external reference, for example so that rollers of multiple brackets may be made and held parallel with each other. Another object of the invention is to provide a shoring bracket that can be quickly installed on columns or walls of any spacing and accept pre-made forms, trusses or other structures made in, or adjustable between, widths differing by a constant interval. Another object of the invention is to provide a structure for spanning between shoring brackets or other supports that is adjustable between various widths. Another object of the invention is to provide a structure for spanning between shoring brackets or other supports that can be pre-cambered so as to have acceptable deflection when loaded. These and other objects of the invention are met by the combination of features, steps or both described in the claims. The following summary may not describe all necessary features of the invention which may reside in a sub-combination of the following features or in a combination of some or all of the following features and features described in other parts of this document.

In some aspects, the invention provides a shoring bracket that may be broken down into three or four sub-assemblies; a support, a jack, a head and an alignment bracket, the alignment bracket optionally being part of the head sub-assembly. The support sub-assembly attaches to a column, wall or other supporting surface of a structure being constructed. The jack sub-assembly is attached to the support and has a part with a variable height ability relative to the support. The head sub-assembly is attached to the part of the jack that varies in height relative to the support. The jack sub-assembly may also be adapted for use with other types of supports, such as a post shore.

The head has a head base that supports one or more rollers. The rollers are adapted to support a slab, form or other structure while moving the form into or out of a position over the shoring bracket. The head also has a supporting plate for supporting the form in position over the shoring bracket. The supporting plate is connected to the head base so that it can slide vertically relative to the head base and the rollers. In particular, the supporting plate may be slid upwards and fixed in a position where the top of the supporting plate is above the top of the rollers or slid downwards so that the top of the supporting plate is below the top of the rollers.

In an embodiment, the connection between the supporting plate and the head base is made between a supporting plate element that extends downwards from the supporting plate and a head base element that extends upwards from the head base. The supporting plate element and head base element can slide one within the other, the outer dimensions of one fitting within the inner dimensions of the other. For example, the supporting plate can be a vertically oriented rectangular section which and the head base element can define a slightly larger rectangular cavity. By sliding the supporting plate element relative to the head base element, holes in the elements can be aligned horizontally to accept a pin or wedge having an elongated tapered section. The holes may differ in size to correspond with the taper of the pin or wedge and may also be tapered to frictionally receive the pin. When the pin or wedge is inserted into the holes so that a wider portion of the pin contacts the holes, the supporting plate is lifted and held so that its upper surface is above the upper surface of the rollers. When the pin or wedge is driven out so that a narrower portion contacts the holes, the supporting plate is lowered so that its upper surface is below the upper surface of the rollers.

In other aspects, the invention provides an alignment tool for aligning the angular position of the rollers in a horizontal plane with an external reference. The external reference may be, for example, the side of a column, a wall, a laser or other type of sight or a jig between columns or walls.

In an embodiment, the jack may be prevented from rotating and the head is fixable but rotatable in a horizontal plane relative to the jack. An alignment tool may communicate with the head for aligning the angular position of the rollers in a horizontal plane with an external reference. Once aligned, the head containing the rollers is fixed to the jack so that they can no longer rotate.

In another aspect, the invention provides a shoring bracket wherein an attachment between a head and a jack is pivotable.

In another aspect, the invention provides a shoring apparatus. The shoring apparatus has a plurality of shoring brackets mountable in opposed sets, each set attached to opposed lines of columns or other supporting surfaces. The shoring apparatus also has one or more forms or supports for forms that can be made or assembled in a plurality of widths within a range, the widths differing by an increment. The forms also have form members that rest on supporting plates of the shoring brackets. The jacks of the shoring brackets may be attached to the support in at least two positions, the two positions being spaced in the horizontal direction between the opposed sets of shoring brackets by one half of the increment. The supporting plates are wider than the form members by at least one half of the increment in the horizontal direction between the opposed sets of shoring brackets. In this way, form can be selected or assembled such that it can be installed between columns spaced at any distance apart within the range.

In another aspect, the invention provides a truss for spanning between an opposed pair of supports in a shoring system, for example to provide a form or support for a form. The truss has at least one adjustable member with an adjustable length. Adjusting the length of the adjustable member causes the truss to become pre-cambered. The amount of pre-camber can be selected such that the truss, when fully loaded in use, will have an acceptable deflection relative to a horizontal line. For example, the truss may have one or more truss members forming a generally horizontal cord, a pair of diagonal members and an adjustable member. The adjustable member is oriented generally vertically with its upper end connected to the middle of the horizontal cord of the truss. The diagonal members are connected between the lower end of the adjustable member and the two ends of the horizontal cord. Increasing the length of the adjustable member creates tension in the diagonal members and causes the truss to be pre-cambered upwards. The truss may also have additional members. For example, there may be one or more truss members forming a second generally horizontal cord generally parallel to and above the first-mentioned cord and a plurality of struts between the generally horizontal cords.

In another aspect, the invention provides a truss having a plurality of sections for spanning between an opposed pair of supports in a shoring system. A first truss section has first section upper and lower generally horizontal cords separated by first section struts. A second truss section has second section upper and lower generally horizontal cords separated by second section struts. The second section upper and lower cords can be attached to first ends of the first section upper and lower cords in a plurality of locations along the length of the first section cords. In this way, the truss may be assembled in a plurality of widths. The truss may also have additional sections, for example a third truss section. The third truss section has third section upper and lower generally horizontal cords separated by third section struts. The third section upper and lower cords can be attached to second ends of the first section upper and lower cords in a plurality of locations along the first section cords. In this way, the truss may be assembled in an additional plurality of widths. Optionally, the truss may be assembled in a plurality of widths with the first truss section remaining generally near the middle of the assembled truss. The truss may also have a member with an adjustable length to allow the truss to be pre-cambered. For example, the truss may have an adjustable member oriented generally vertically with its upper end connected to the first truss section lower cord, for example at about the middle of that cord. A pair of diagonal members may be connected between the lower end of the adjustable member and (one to each) to the distal ends of the lower cords of the second and third truss sections. Increasing the length of the adjustable member creates tension in the diagonal members and causes the truss to be pre-cambered upwards.

In another aspect, the invention provides a truss, for example any of the trusses described above, having pairs of cords that may slide within and relative to the lengths of each other. For example, the pairs of cords may be made up of a cord of a first truss section and an adjacent or corresponding cord of a second or third truss section. The cords of each pair of cords may have a plurality of engaging surfaces, for engaging each other, and strut attaching surfaces for bolting struts to the cords. The engaging surfaces may maintain a separation between the strut attaching surfaces of the pairs of cords. The separation may be made at least as large as the sum of the thickness of the heads of bolts used to bolts struts to the cords such that the pairs of cords may slide relative to each other without the heads of the bolts associated with either cord contacting the heads of the bolts associated with the other cord. For example, the cords of each pair of cords may be made generally in the shape of C-channels. The cords are oriented such that the flanges of one of the cords extend to the left of its web and the flanges of the other cord extend to the right of its web. The webs provide the strut attaching surfaces and are separated from each other by the flanges. The flanges may be sized to provide the separation between the webs. The flanges may also be shaped such that the cords may be initially put together in a rough alignment but such that bolting the pair of cords together draws them into a more nearly co-linear alignment. The cords of at least one of the pair of cords may be provided with one or more lines of holes spaced horizontally in each line of holes by a selected increment. At least one corresponding hole is provided in the other truss section for each line of holes so that truss sections may be bolted together to provide a plurality of spans differing by the selected increment.

In another aspect of the invention, shoring brackets of one or more of the types described above are combined with one or more of the trusses described above to provide a shoring apparatus or system. For example, two generally parallel lines of brackets, the brackets typically but not always being in generally opposed pairs, may be installed onto columns, walls, other permanent supporting structures or other shoring devices such as post shores. A plurality of trusses are assembled at a span suitable for the distance between the lines of brackets. The trusses are attached to a sill beam or sill truss running parallel to and bearing on each line of shoring brackets. Cross bracing may be added as desired or required between adjacent trusses. The trusses may be pre-cambered as required for the expected loading. The shoring brackets are placed so that, with adjustable parts of the shoring brackets raised the tops of the trusses provide support, for example, for a mold in which to pour concrete to enable a permanent structure to be built above the trusses. When the concrete is set, the adjustable parts of the shoring brackets are lowered. With the shoring brackets lowered, the form mold may be striped. Then the assembly of trusses can be rolled out from under the concrete and the shoring brackets may be removed and reused, for example, on the floor above or in another area.

BRIEF DESCRIPTION OF THE DRAWINGS

For a better understanding of the invention, and to show more clearly how it may be made and used, one or more exemplary embodiments of the invention will be described below with reference to the following drawings:

FIGS. 28A-1 and 28A-2 show exploded and assembled section views of the truss of FIG. 27B through section line 28*a*-28*a*.

FIGS. 29A-1, 29A-2 and 29B are enlarged views of cords of the truss shown in FIGS. 28A-1, 28A-2 and 28B, respectively.

DETAILED DESCRIPTION OF THE INVENTION

Figure 1:
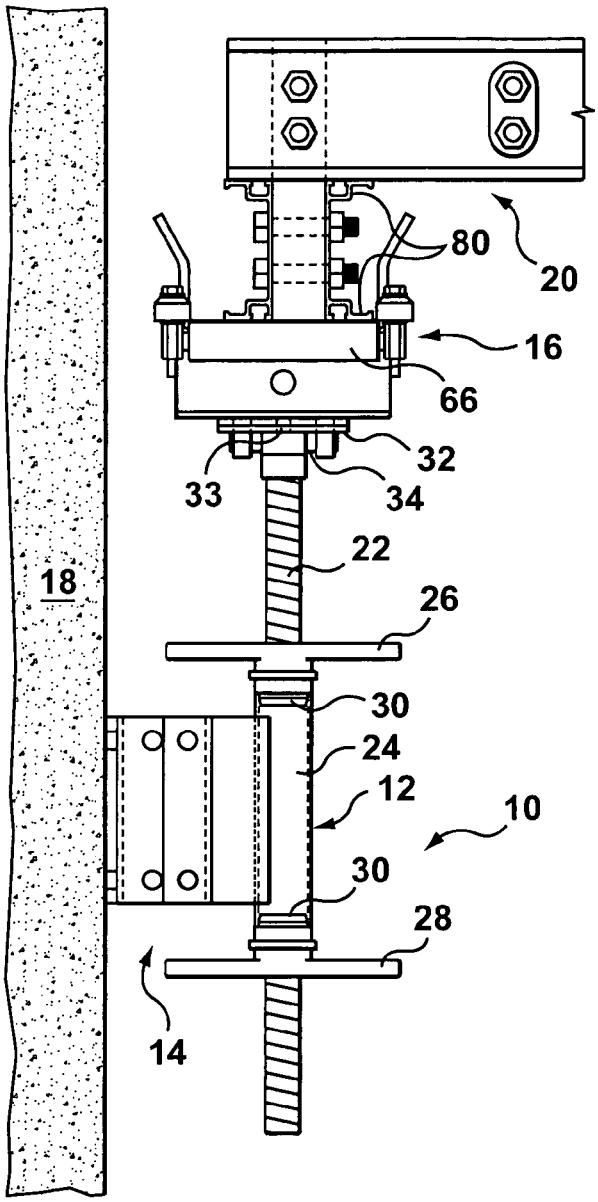
FIGS. 1 and 2A are side and front views respectively of an exemplary embodiment of a column or wall hung shoring bracket.
Figure 2A:
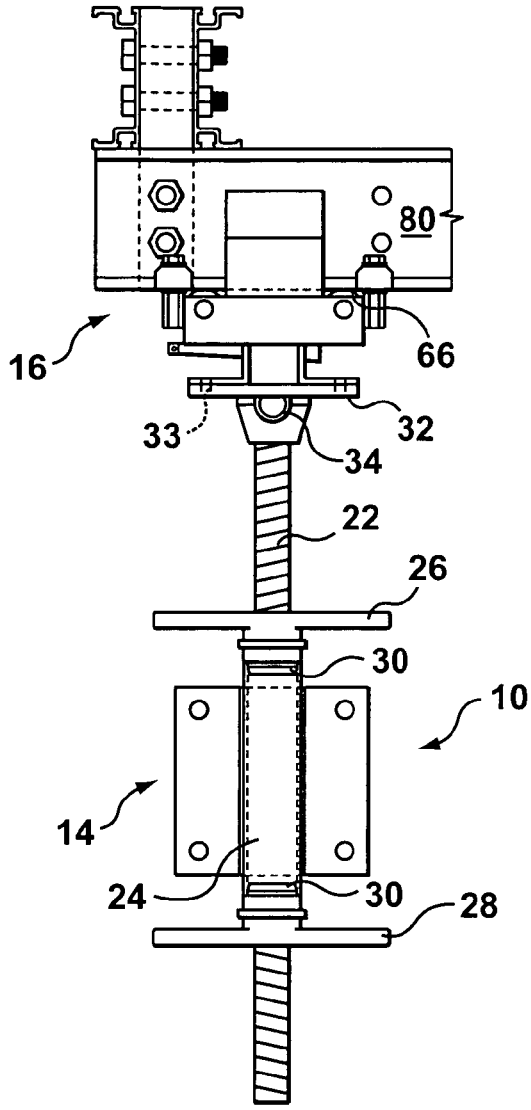
Figure 2B:
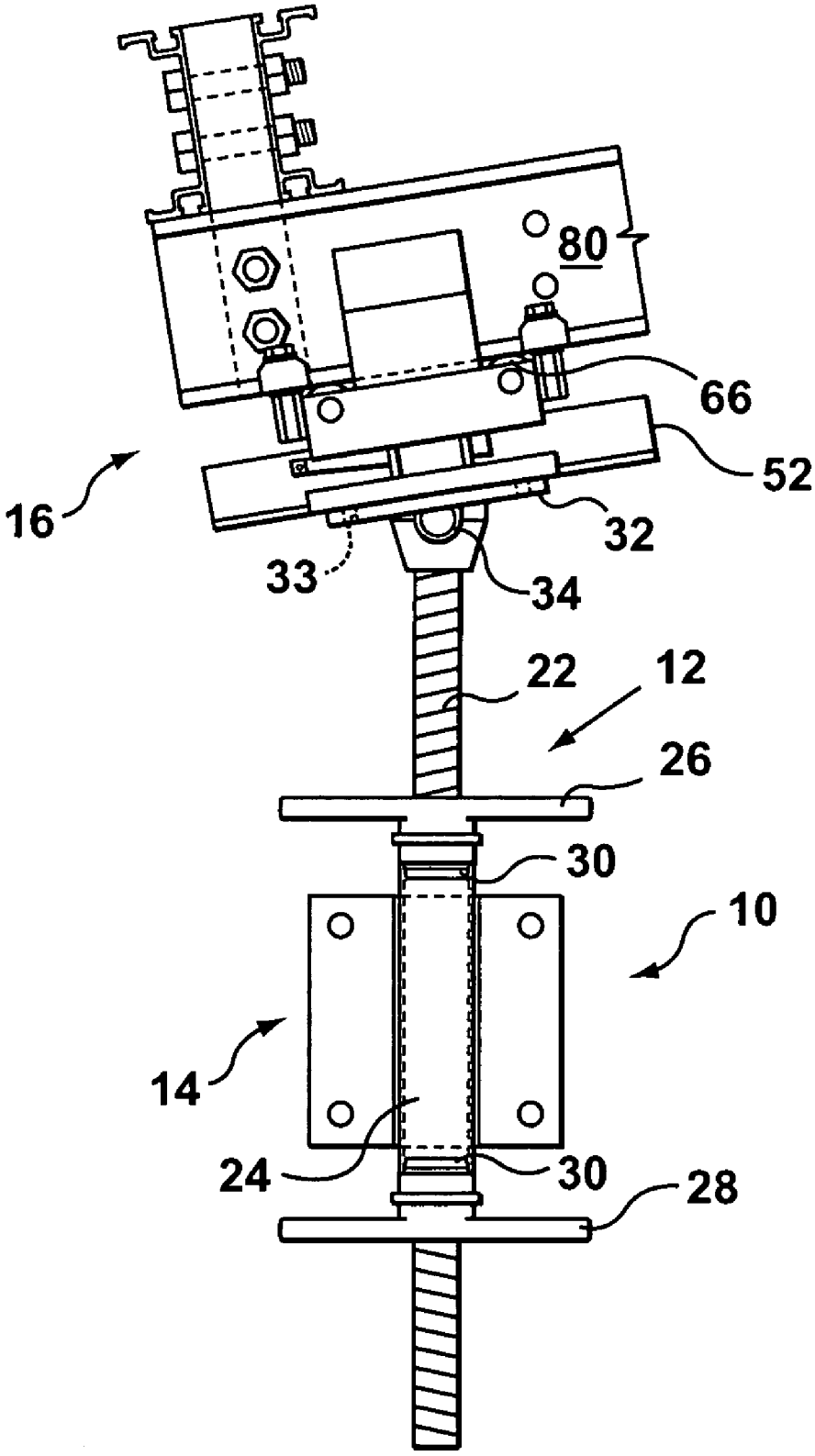
FIG. 2B is a front view of the bracket of FIG. 2A in a pivoted orientation.
Figure 3:
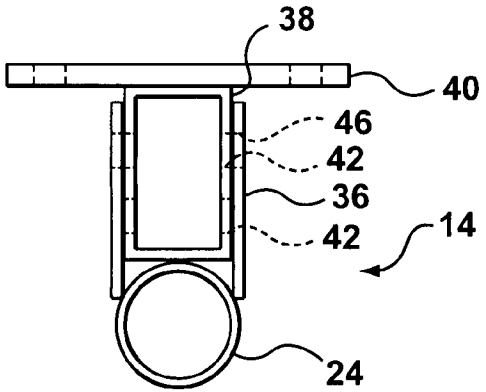
FIGS. 3 and 4 are top and front views of a support of the shoring bracket of FIGS. 1, 2A and 2B.
Figure 4:
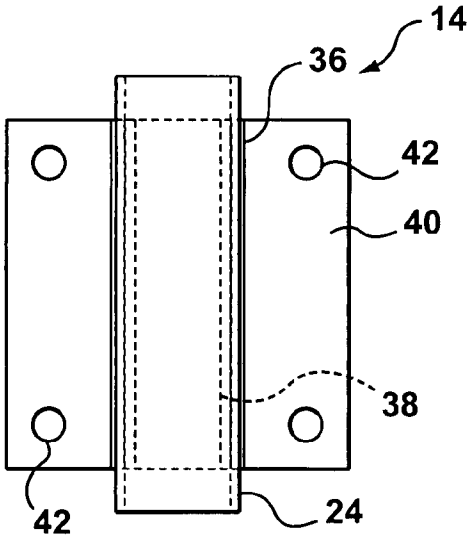

FIGS. 1, 2A and 2B show a shoring bracket 10 according to a first embodiment of the invention. The shoring bracket 10 has three sub-assemblies: a jack 12, a support 14 and a head 16. The support 14 provides an attachment between the jack 12 and a column 18, the column 18 being typically steel or reinforced concrete, or other supporting surface. The jack 12 is adjustable so that a portion of it may be moved up or down relative to the support 14. The head 16 is attached to the movable portion of the jack 12 and is used to support a form 20 or other structure. Although the shoring bracket 10 will be described below as attached to columns 18, the shoring bracket 10 may also be attached to walls or other vertical structures, or even to non-vertical structures with some modification. The jack 12 (or parts of the jack 12) and head 16 of the shoring bracket 10 may also be used with a post shore in place of the support 14. Post shores may be used in place of or between supports 14 attached to columns or other surfaces. The shoring bracket 10 may be made primarily of aluminum to reduce the weight of each sub-assembly.

The jack 12 has a threaded rod 22 that slides inside of a sleeve 24. An upper wing nut 26 rotates on the threaded rod 22 and abuts the top of the sleeve 24. Rotating the upper wing nut 26 raises or lowers the threaded rod 22 relative to the sleeve 24 and support 14. A lower wing nut 28 may also be threaded onto the threaded rod 22 to abut the bottom of the sleeve 24. With the upper wing nut 26 set in a desired position, the threaded rod 22 may be releasably but firmly fixed at a desired height and prevented from rotating or wobbling by tightening the lower wing nut 28. As well as abutting the sleeve 24, the wing nuts 26, 28 may have a narrow section 30 that fits inside of the sleeve 24 and centers the wing nuts 26, 28 relative to the sleeve 24. This further inhibits the threaded rod 22 from wobbling in the sleeve 24. Wing nuts 26, 28 without these narrow sections 30 may also be used in which case the outer diameter of the threaded rod 22 is made closer to the inner diameter of the sleeve 24. This embodiment will also function without the lower wing nut 28, but it may be less convenient to use since it may then rotate or wobble if it is bumped before it is loaded with weight.

The top of the threaded rod 22 is fitted with a head mounting plate 32. The head mounting plate 32 may be attached to the threaded rod 22 through a jack pivot 34. The jack pivot 34 may be generally parallel to primary rollers 66 (which will be discussed below) or may be generally perpendicular to primary rollers 66. In some embodiments or methods of using embodiments, the jack pivot 34 may be made substantially parallel or perpendicular to primary rollers 66. This pivotable connection between the head mounting plate 32 and the threaded rod 22 is particularly useful for building stairways, sloped floors or roofs or other non-horizontal structures, the axis of the jack pivot 34 being oriented as required for the desired slope. FIG. 2B shows the head mounting plate 32 in a pivoted position. The head mounting plate 32 has head mounting holes 33 made to accept bolts for fastening the head 16 to the head mounting plate 32.

Other sorts of jacks 12, such as tractor jacks or hydraulic jacks, may also be used although they are typically more expensive and may not provide as fine a height adjustment. Other forms of screw jacks may be used, such as those having a threaded rod that turns in a threaded sleeve, but with these the angular position and height of the threaded rod cannot be independently varied. Accordingly, a connection that can be rotated through a large angle will be required between the threaded rod 22 and head mounting plate 32 or head 16, or some ability to make fine height adjustments may be lost.

FIGS. 3, 4, 5A and 5B show the support 14 in more detail. Two sleeve plates 36 are welded to the sleeve 24 to form a pair of vertical, parallel planes. A mounting block 38 fits inside of the sleeve plates 36 and is welded to a mounting plate 40. The mounting plate 40 has mounting plate holes 42 to accept bolts for attaching the mounting plate 40 to a column. Various other means, such as clamps or other connections using bolts, may be used to attach the mounting plate 40 to the column 18 or walls etc.

Figure 5A:
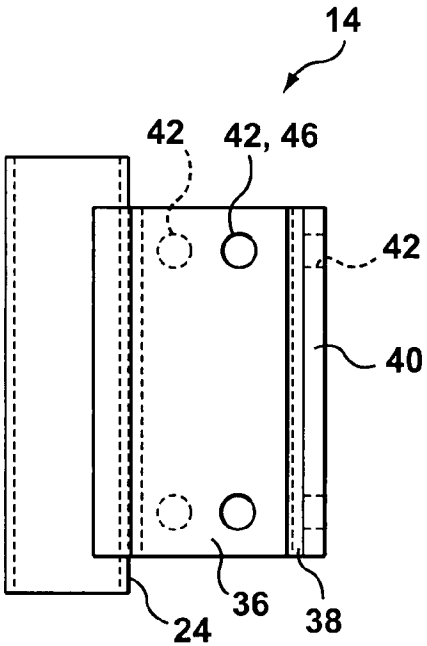
FIGS. 5A and 5B are side views of the support of FIGS. 3 and 4 with a sleeve of the support located at different distances relative to a mounting block of the support.
Figure 5B:
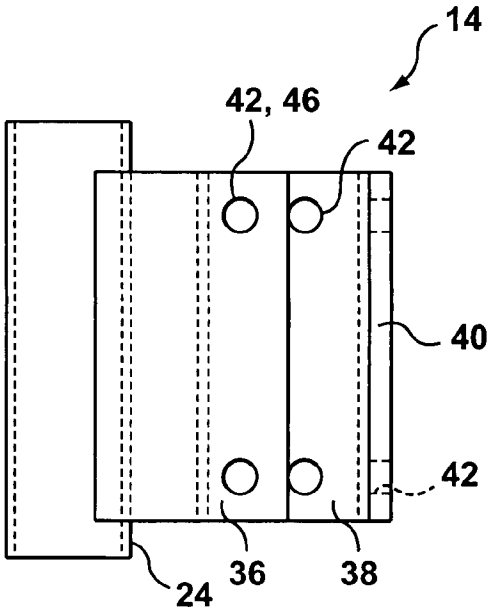

The mounting block 38 has two or more sets of mounting block holes 42, each set being located along a vertical line but at different horizontal distances from the mounting plate 40. The sleeve plates 36 each have a set of sleeve plate holes 46 located to line up with the sets of mounting block holes 42. By choosing which set of mounting block holes 42 to align with the sleeve plate holes 46, an installer can locate the sleeve 24 at different horizontal distances from the mounting plate 40 as shown in FIGS. 5A and 5B. As will be discussed below, the shoring bracket 10 may be used with forms 20 which can be made in widths varying within a range by a short increment, for example 3 inches. When used with such a form 20, two sets of mounting block holes 44 may be spaced apart by about one half of the increment, for example 1.5 inches if the increment is 3 inches. This allows a head 16 with the features discussed below to be positioned to accept the form 20 regardless of the distance between opposed columns 18, provided that the distance between opposed columns is within the range. Alternately, slots may be provided in one or both of the sleeve plates 36 or mounting block 38. This allows the distance between sleeves 24 on opposed columns 18 to be varied infinitely as required to fit a form 20 as described above without a head 16 as described above, of to fit other types of forms. Other mechanisms, such as a carriage that can be positioned on a ledge or other structure extending horizontally from a column 18, may also be used to allow the sleeve 24 to be positioned at various horizontal distances from the column 18. If a different sort of form will be used, for example a form that is made in place after the shoring brackets 10 are erected, then it may not be necessary to allow for mounting the sleeve 24 at multiple distances from the mounting plate 40. In such a case, the support 14 may be permanently or semi-permanently attached to the jack 12, although the resulting assembly may then be heavy and more difficult to install than two smaller assemblies.

Figure 6:
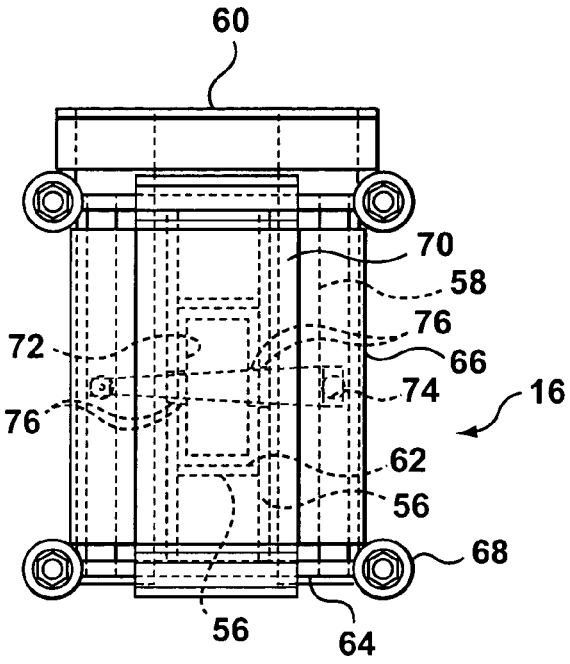
FIGS. 6, 7 and 8 are top, front and side views of a head of the shoring bracket of FIGS. 1, 2A and 2B.
Figure 7:
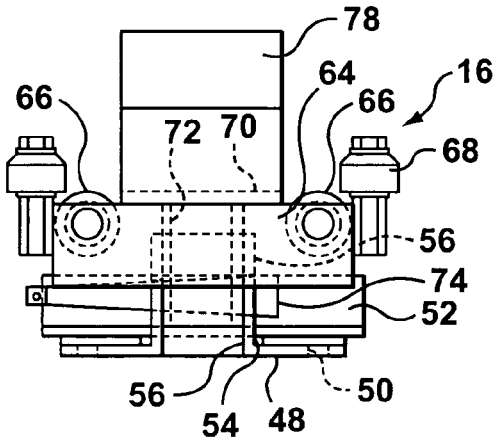
Figure 8:
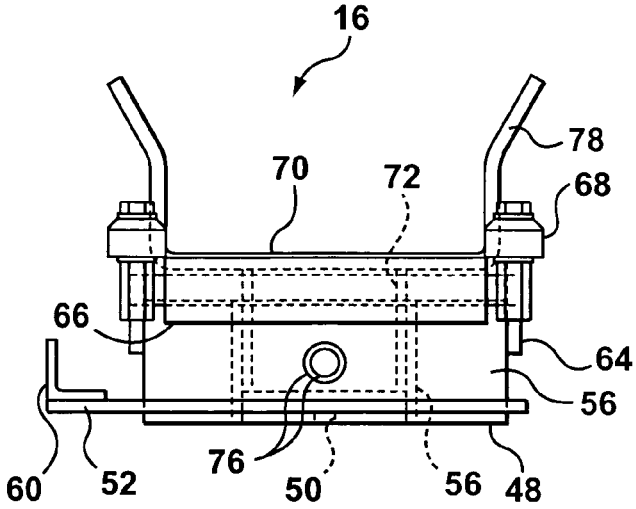

FIGS. 6, 7 and 8 show a head 16. FIGS. 10, 11, 12, 13, 14, 15, 16, 17, and 18 also show various components of the head 16 separated from each other. Referring to these FIGS. and FIGS. 1, 2A and 2B the head 16 has a head base 48 with head base holes 50. The head base holes 50 accept bolts for attaching the head 16 to the head mounting plate 32 of the jack 12. One or both of the head base holes 50 or the head mounting holes 33 may be made oversize relative to the bolts passing through them. This allows the head base 48 to be rotated slightly relative to the head mounting plate 32 of the jack 12. The jack 12 can then be raised to the desired height and rotated so that, by eye or by the eye aided for example with a laser sight, the head mounting plate 32 is positioned such that the head 16 will be roughly oriented relative to an external reference, such as the column 18. This alignment by eye may be sufficiently accurate to allow the shoring system to function. However, where a fast and accurate alternate method of final alignment of the head 16 is desired, an alignment tool 52 may be provided, for example on the head 16. The alignment tool 52 is kept square to the head 16 but may slide from side to side relative to the head 16. In this embodiment, this motion is achieved through guides 54 which slidably engage a pair of opposed parallel surfaces presented by two of four base walls 56 welded to the head base 48. Alignment tool slots 58 allow bolts slipped through the head base holes 50 to also pass through the alignment tool 52.

To install the head 16 on a jack 12 that has been fixed in position, the head 16 is placed on top of the head mounting plate 32. Bolts are passed through the head base holes 50, the alignment tool slots 58 and head mounting holes 33. The heads or nuts of these bolts may have pins through them, or other features that keep them from rotating relative to the head 16, to allow the bolts to be tightened with a single tool from below. The alignment tool 52 is then pressed against an external reference, such as the face of a column 18 or a board placed across multiple columns 18, until its face 60 is flat against the reference. This may be done, for example, by tapping the alignment tool 52 with a hammer. The bolts are then fully tightened to fix the head 16 to the jack 12 and the alignment tool 52, which is fixed in position against the external reference. In this way, a single or multiple heads 16 can be aligned directly to an external reference. Other sorts of alignment tool may also be used to align the head 16 directly to an external reference before the head 16 is rotationally fixed.

Alternately, the lower wing nut 28 of the jack 12 may be kept slightly loose so that the threaded rod 22 of the jack 12 can rotate. The head 16 can then be fixed to the threaded rod 22 before the head 16 is aligned to the external reference. The head 16 is later aligned to the external reference and, once aligned, the lower wing nut 28 is fully tightened to prevent the threaded rod 22 from rotating further and to preserve the alignment. This method avoids the need for a rotatable connection between the head 16 and the jack 12 or allows the head mounting plate 32 or other parts to be omitted or simplified. However, the jack 12 remains in a less secure state for a longer part of the process and an alignment tool, if one will be used, must be provided in a location that does not contact the bolts between the head 16 and the jack 12. Further alternately, the head 16 may be made freely rotatable on the jack 12, for example by omitting the head mounting plate 32 and attaching a tube on the bottom of the head base 48 that slips over but does not otherwise engage the threaded rod 22. A lower wing nut 28 may now be used or not used as desired. The head 16 may still aligned to the external reference with an alignment tool 52, if desired, by sliding the alignment tool 52 so that its face 60 is flat to the external reference. The alignment tool 52 is then fixed to the head 16 to preserve the alignment, for example by tightening a bolt through the alignment tool slots 58 and the head base holes 50 while the face 60 of the alignment tool 52 is pressed flat against the external reference. In this way, even though the jack 12 may rotate relative to the head 16, the head 16 remains aligned to the external reference. With these alternatives, other alignment tools could be used, including alignment tools that work between the jack 12 and the external reference.

The shoring bracket 10 or alternate designs described above could also be modified so that the head 16 is not removable from the jack 12, whether the head 16 may rotate on the jack 12 or not. However, having a head 16 that may be removed from the jack 12 creates conveniently sized sub-assemblies. In particular, an installer can manually lift and position each sub-assembly without undue difficulty while the total number of separate sub-assemblies remains small. The sub-assemblies are easily connected and stripped and the alignment of the head 16 does not necessarily depend on the column 18 or other supporting surfaces being aligned. Alignment of the head 16 can be done with only a single wrench worked from below or a wrench and a hammer if an alignment tool 52 is used.

FIGS. 6, 7 and 8 show other features of the head 16. Two of the base walls 56 extend from side to side across the head base 48. These two base walls 56 have a pair of vertical end plates 64 welded to them. The end plates 64 support a pair of primary rollers 66 which allow the form 20 to be rolled into or out of position. A single primary roller 66 may also be used. Optional guide rollers 68 or other guides may also be attached to the end plates 64 to help keep the form 20 properly located over the primary rollers 66. Guide rollers 68 may have a tapered top section to assist in guiding the form 20 onto the supporting plate 70 or primary rollers 66.

Although the primary rollers 66 support the form 20 while it is being positioned, a supporting plate 70 supports the form 20 while the form 20 is in use and bearing weight. The supporting plate 70 has a rectangular section 72 welded below it. The rectangular section 72 slides up or down in the square or rectangular cavity 62 created by the base walls 56 but does not rotate significantly, either in horizontal or vertical planes, within the cavity 62. Other shapes, such as circular sections or a mix of rectangular and circular sections, may also be used although the closely fitting rectangular sections keep the supporting plate 70 and head base 48 aligned at all times. Choosing sections that preserve the rotational or horizontal alignment of supporting plate 70 and head base 48 is not necessary since a pin 74 may also function to preserve these alignments in use. However, such sections are beneficial at least in that they reduce the amount that the supporting plate 70 may rotate or translate as the tapered pin 74 is moved in and out as described below.

Up and down movement of the supporting plate 70 is achieved through a tapered pin 74 or wedge interacting with optionally tapered holes 76 in the base walls 56 and the rectangular section 72. When the tapered pin 74 is inserted into the tapered holes 76, the supporting plate 70 is driven upwards so that the top of the supporting plate 70 is above the top of the primary rollers 66. The supporting plate 70 thus supports the form 20 while the form is being used and loaded with weight. When the form 20 is no longer required, the tapered pin 74 is knocked at least partially out of the tapered holes 76 which allows the top of the supporting plate 70 to drop below the top of the primary rollers 66. The top of the primary rollers 66 are located far enough below the height of top of the supporting plate 70 with the form 20 loaded so that the form 20 drops free of the work above and rests on the primary rollers 66. Thus the primary rollers 66 may designed for the weight of the form 20 alone and the form 20 can be rolled in or out of position on them. The ends of the tapered pin 74 may be fitted with cotter pins or other means to keep the tapered pin 74 from being separated from the head 16 or from fully exiting the holes 76. The tapered pin 74 may be made with square or rectangular cross-sections to provide more bearing capacity. A flat wedge may also be used in place of the tapered pin 74. Other height adjusting mechanisms might also be used between the supporting plate 70 and the head base 48. For example, pairs of wedges or a cam, pivotable on one of the supporting plate 70 or head base 48 and bearing on the other, might be used to raise or lower the supporting plate 70 relative to the head base 48.

The supporting plate 70 may be flat or may have supporting plate sides 78. The supporting plate sides 78 further contain the form 20 and may angle outwards as shown to assist in guiding the form 20 into place. Optionally, means for securing the form 20 to the supporting plate 70 may be added, but are not typically required.

The relevant parts of the head 16 are sized to permit a maximum width of an object that may rest on the supporting plate 70. This maximum width may exceed the expected width of any part of the form 20 that will rest on the supporting plate 70. For example, the distances between the insides of the supporting plate sides 78, or between the insides of any guide rollers 68, may be made to exceed the width of a sill beam 80 of the form 20. This allows a pre-made form 20 to rest on the supporting plate 70 even if the distance between opposed sill beams 80 of the form 20 are not precisely the same as the distance between the centers of an opposed pair of supporting plates 70. Further, forms 20 may be pre-made in any of a set of spans with a range, the spans differing from each other by a fixed width increment, for example 3 inches. In this case, the maximum width can be made at least one half of the increment, i.e. 1.5 inches, wider than the sill beam 80 of the form 20. In combination with a support 14 as described above that permits the distance between opposed pairs of jacks 12 to be altered, such a head 16 will permit a pre-made form 20 available in widths varying by the incremental size to be selected to fit any random distance within the range between opposed columns 18. Alternately, the width between guide rollers 68 may be made closer to the width of sill beam 80, or other relevant part of the form 20, by mounting guide rollers 68 closer together or using larger diameter guide rollers 68. When provided at a closer width, guide rollers 68 may assist in keeping primary rollers 68 oriented with their axis of rotation perpendicular to sill beam 80 while rolling sill beam 80 onto or off of the shoring bracket 10. Accommodation for forms 20 of various widths may also be provided by replacing head mounting holes 33 with slots in the head mounting plate 32 or otherwise permitting the head 16 to be mounted at various positions on the jack 12.

Figure 9:
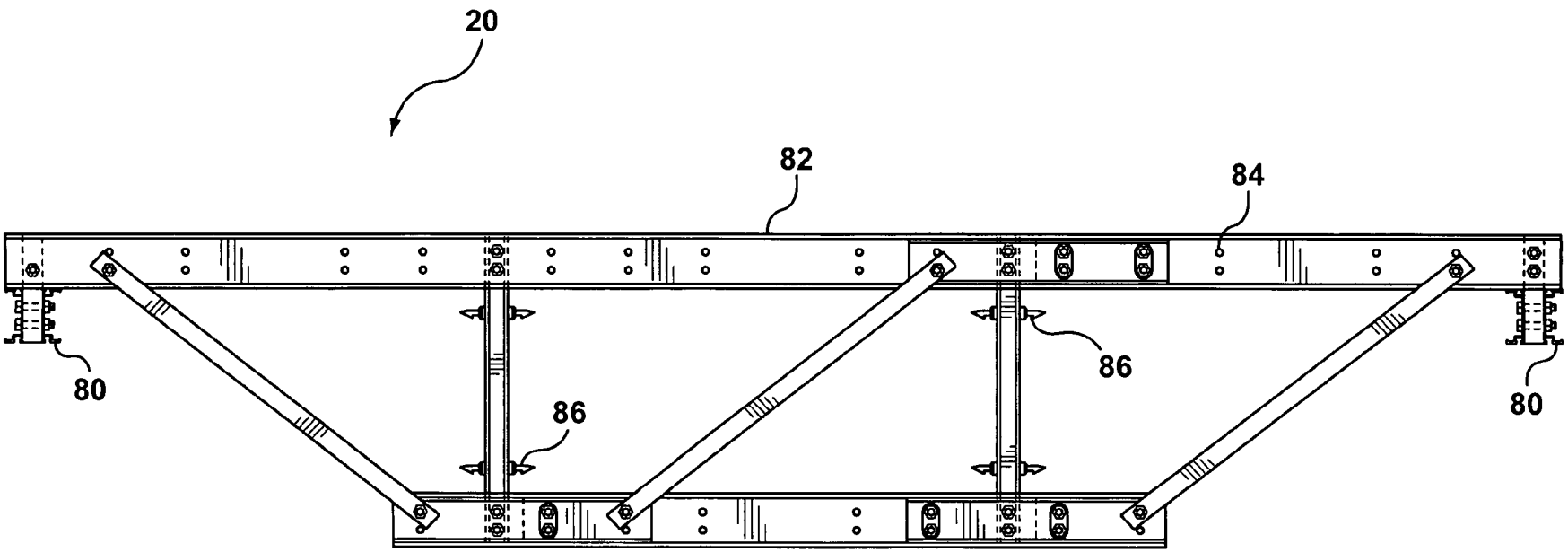
FIG. 9 is a side view of part of an exemplary embodiment of a form or form supporting truss.
Figure 10:
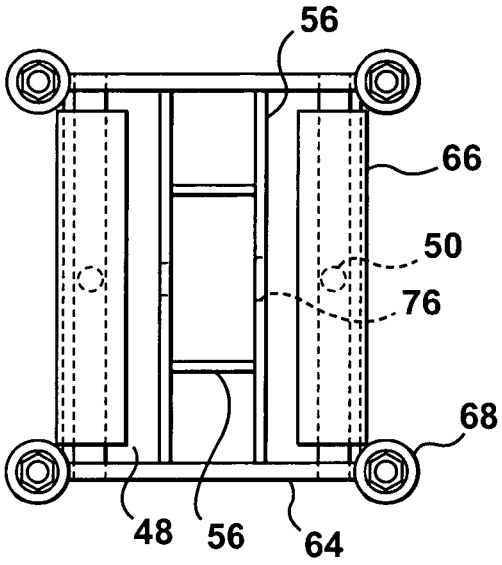
FIGS. 10 to 18 show orthographic projections of various sub-assemblies of the head of FIGS. 6, 7 and 8.
Figure 11:
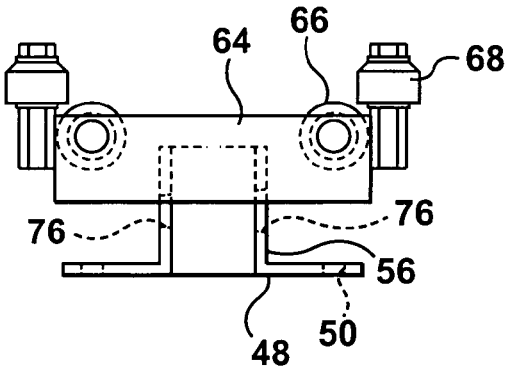
Figure 12:
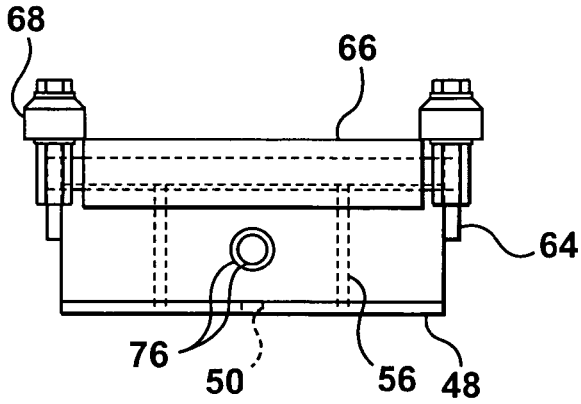
Figure 13:
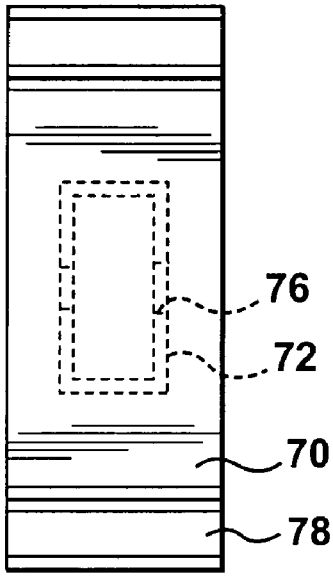
Figure 14:
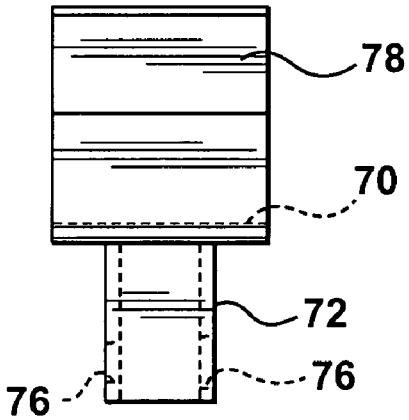
Figure 15:
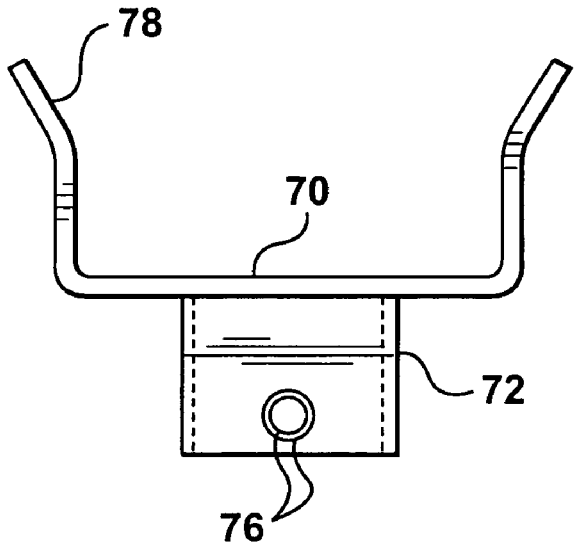
Figure 16:
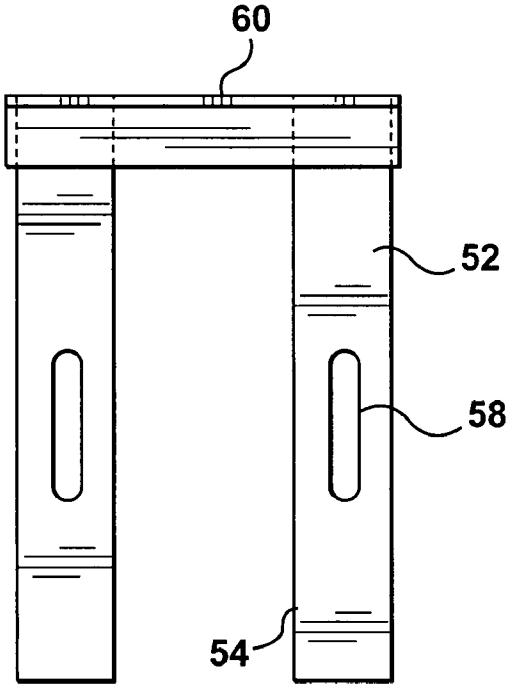
Figure 17:
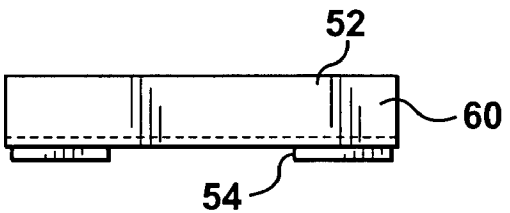
Figure 18:
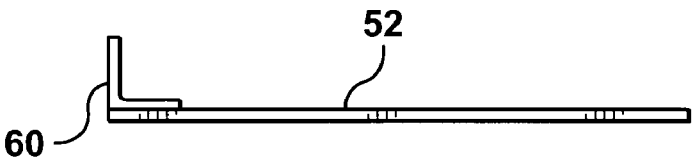
Figure 19:
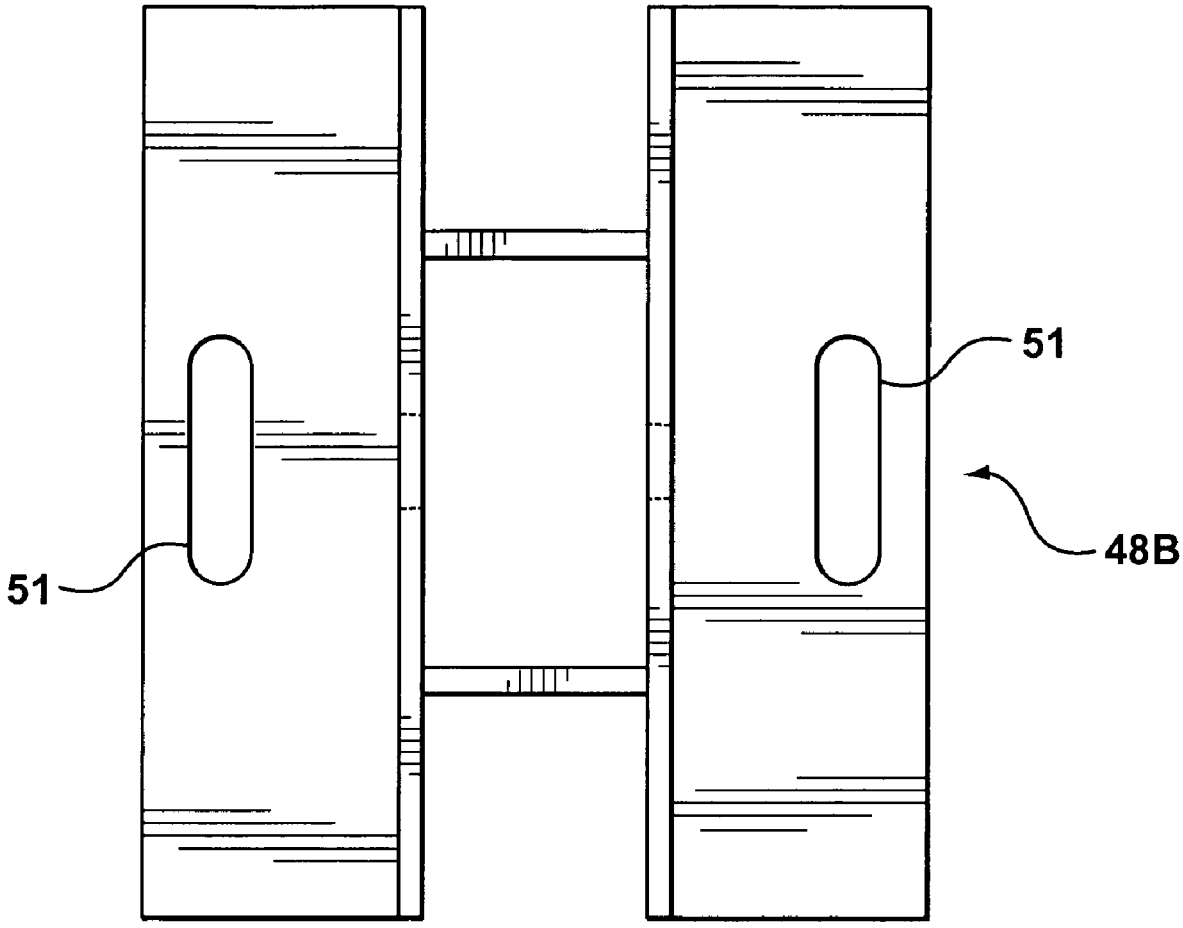
FIG. 19 shows an alternative head base.

FIG. 9 shows parts of a form 20. The form 20 has a pair of sill beams 80, each sill beam spanning across one of a pair of opposed lines of shoring brackets 10. The sill beams 80 in turn support a plurality of trusses 82. The trusses 82 and sill beams 80 are made of lengths of extrusions, for example of aluminum, which are bolted together to form efficient load carrying shapes. The configuration of the trusses 82 may vary from the shape shown for different spans. Multiple sets of trusses 82 may be made in regular increments, for example 3" increments, of length. Alternately, the extrusions may be provided in varying lengths and with extrusion holes 84 at regular intervals. These lengths and intervals are chosen so that trusses 82 can be provided at a range of spans varying by an interval, for example 3". To provide this interval, extrusions holes 84 may be provided at the interval or, to reduce the number of holes, at two or more larger distances that can be used together to create larger intervals. For example, extrusion holes 84 on 6" and 9" intervals can be used to create trusses 82 having spans that vary by 3". The trusses also have quick-connect fittings 86 such as those used in scaffolding for attaching pairs of diagonal cross-members between adjacent trusses 82 in a completed form 20.

Figure 20A:
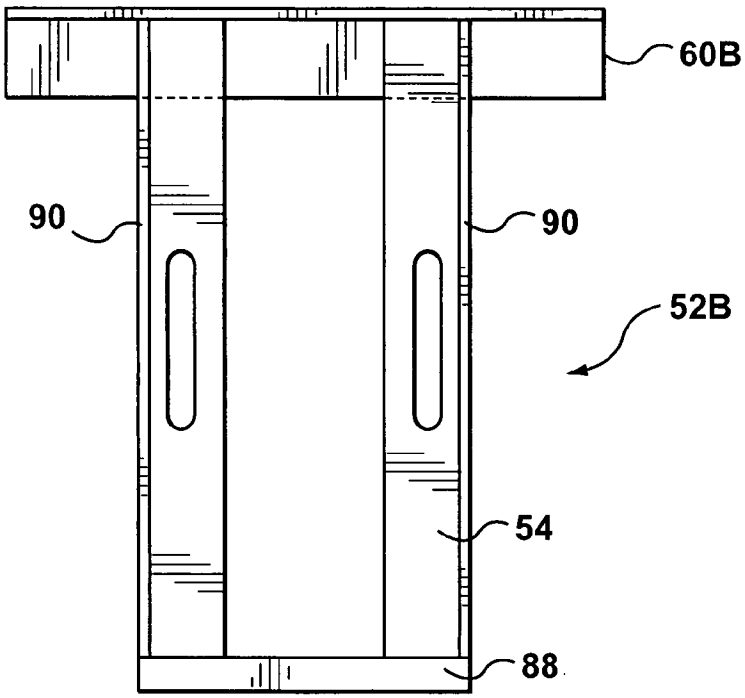
FIGS. 20A, 20B, and 20C are top, front and side views of an alternative alignment tool.
Figure 20B:
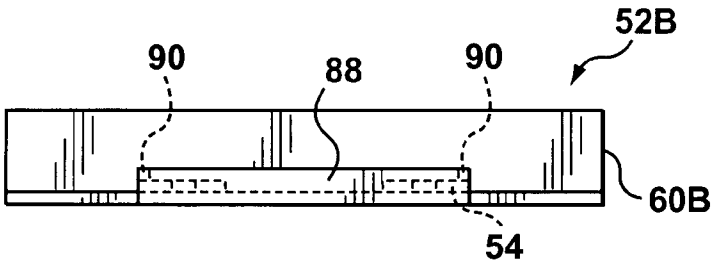
Figure 20C:
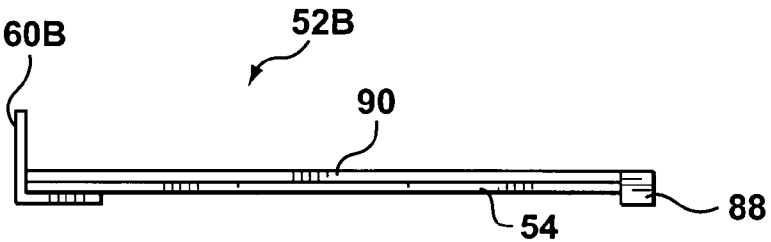
Figure 21B:
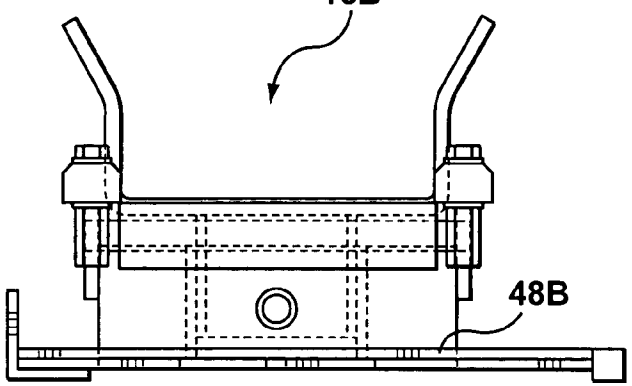
FIGS. 21A, 21B and 21C are front, side and top views of an alternative head incorporating the head base of FIG. 19 and the alignment tool of FIGS. 20A, 20B and 20C.
Figure 21C:
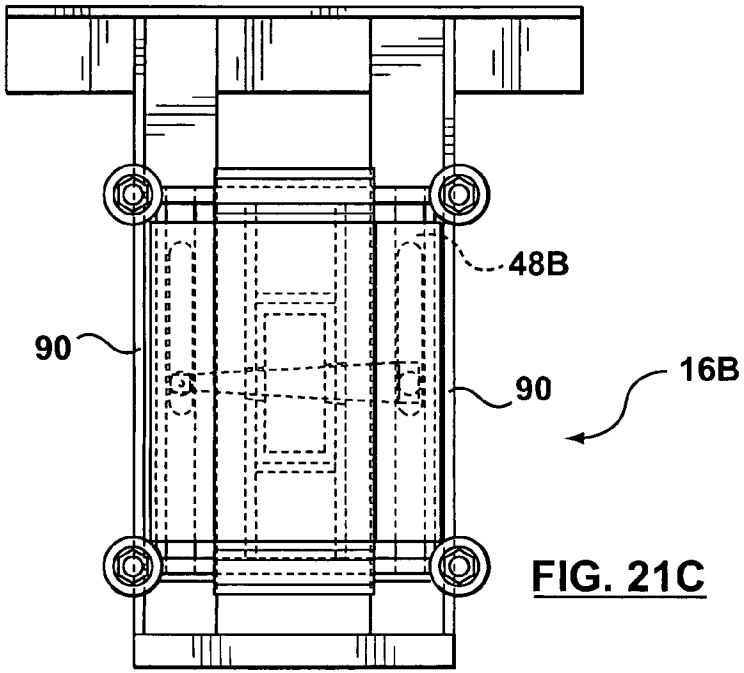
Figure 21A:
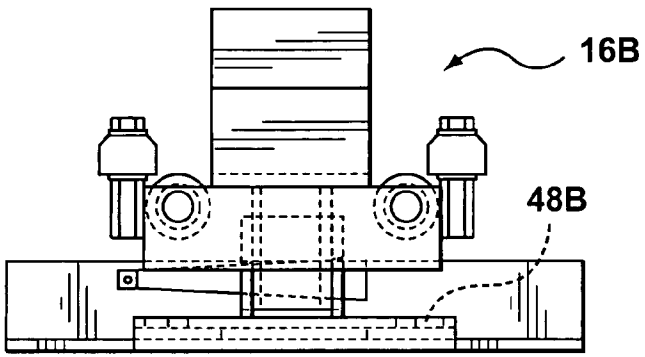

FIGS. 19, 20A, 20B, 200, 21A, 21B and 21C show alternate embodiments of parts shown in FIGS. 6, 7 and 8. Based on the description above and these figures, the structure, use and operation of these alternate embodiments, and how they differ from other embodiments, will be apparent to a person skilled in the art. One difference is that the head base 48B shown in FIG. 19 has head base slots 51 instead of head base holes 50. The head base slots may be 4" long and increase the extent to which the distance between opposed head bases 48B, or between a head base 48B and an adjacent column 18. FIGS. 20A, 20B and 20C show an alternate alignment tool 52B. The alignment tool 52B has a hammering bar 88 for knocking the alignment tool 52B into position and a wider face 60B. The alignment tool 52B also has a pair of guide strips 90 welded to the top edge of the guide 54. The guide strips 90 are parallel to each other and their inside edges are spaced apart by a distance slightly greater than the width of the head base 48B. In this way, the head base 48B can be placed on top of the guides 54 and the guide strips 90 keep the alignment tool 52B aligned with the head base 48B but allow the alignment tool 52B to slide relative to the head base 48B. The shoring bracket 10 is assembled by placing the alignment tool 52B on top of the head mounting plate 32 and then placing the head base 48B onto the alignment tool 52 and within the guide strips 90. The alignment tool 52B is tapped against an external reference to align the head base 48B to the external references, and then a bolt passing through the head base 48B, alignment tool 52B and head mounting plate 32 is tightened to fix the head base 48B in proper position and orientation. FIGS. 21A, 21B and 21C show the head base 48B fitted on the alignment tool 52B. In this embodiment, the alignment tool 52B may be separated from the head 16 and so may be treated as a separate sub-assembly (making 4 sub-assemblies) or as part of the head sub-assembly. Further, the alignment too 52B can be inverted and placed so that the guides 54 rest on the head base 48B, the guide strips 90 extending over the edge of the head base 48B. In this way, the alignment tool 52B cannot be separated from the head 16 without taking the head 16 apart and so is part of the head sub-assembly.

FIGS. 22 to 31 show various elements, including trusses, that may be used as alternatives to the form 20 shown in FIG. 9 or in other shoring systems in which a structure must span between an opposed pair of supports or lines of supports. When discussing trusses, the following paragraphs will use the term "cord" to refer to one or more members of a truss or section of truss that extend generally horizontally in a line when the truss is in an installed system. For example, when referring to a truss or to a section of a truss, the word cord may refer to a single member or to a plurality of members attached together end to end or in a line.

Figure 22:
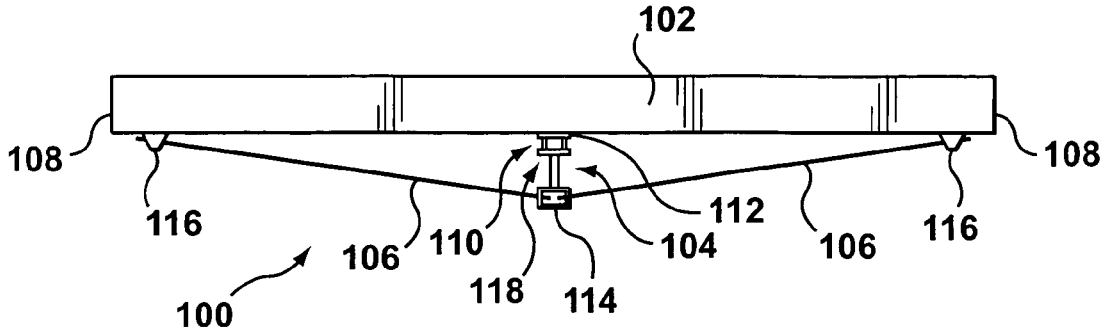
FIG. 22 shows a schematic representation of a truss having means to pre-camber the truss to a desired degree.

FIG. 22 shows a second truss 100 having a cord 102, an adjustable member 104 and a pair of diagonal members 106. The cord 102 has two ends 108 and a middle 110. The cord 102 may be a variety of structures or parts of a variety of structures. For example, the cord 102 may be a simple beam, a pair of simple beams connected at the middle 110 of the cord 102, or a truss, for example the lower cord of a truss of a type shown in FIGS. 9, 24A, 24B, 27A or 27B. The adjustable member 104 has an upper end 112 and a lower end 114. The upper end 112 of the adjustable member 104 is attached to the cord 102 at about or close to its middle 110. The adjustable member 104 is oriented generally vertically and downwards from the cord 102 50 that its lower end 114 is below the cord 102. Each diagonal member 106 is connected between the lower end 114 of the adjustable member 104 and a diagonal end connection 116 at an end 108 of the cord 102.

The adjustable member 104 has an adjustable section 118 that allows the length of the adjustable member 104 to be increased or decreased. Increasing the length of the adjustable section 118 increases the length of the adjustable member 104. Increasing the length of the adjustable member 104 in turn creates or increases tension in the diagonals 106 and causes the cord 102 to deflect, or become pre-cambered, upwards to a variable degree. The amount of pre-camber can be selected so that the cord 102, when loaded, is deflected from the horizontal, typically downwards, to an acceptable degree. For example, with the truss 100 may be configured such that when the adjustable member 104 is at a shorter length and the truss 100 is not loaded by other than its own weight, the cord 102 is essentially horizontal and the diagonals 106 and adjustable member 104 are essentially unloaded. When the adjustable member 104 is at a longer length but the truss 100 is still unloaded, the adjustable member 104 is in compression, the diagonals 106 are in tension and the cord 102 deflects upwards. When the truss 100 is loaded, for example by pouring concrete for a floor onto additional form work supported by the truss 100, the cord 102 deflects downwards, but to within a distance acceptable for the concrete floor or other structure supported by the truss 100. Diagonals 106 might also be shortened to pre-camber the truss, but lengthening the adjustable member 104 requires less force and simultaneously and evenly increases the tension in both diagonals 106.

Figure 23A:
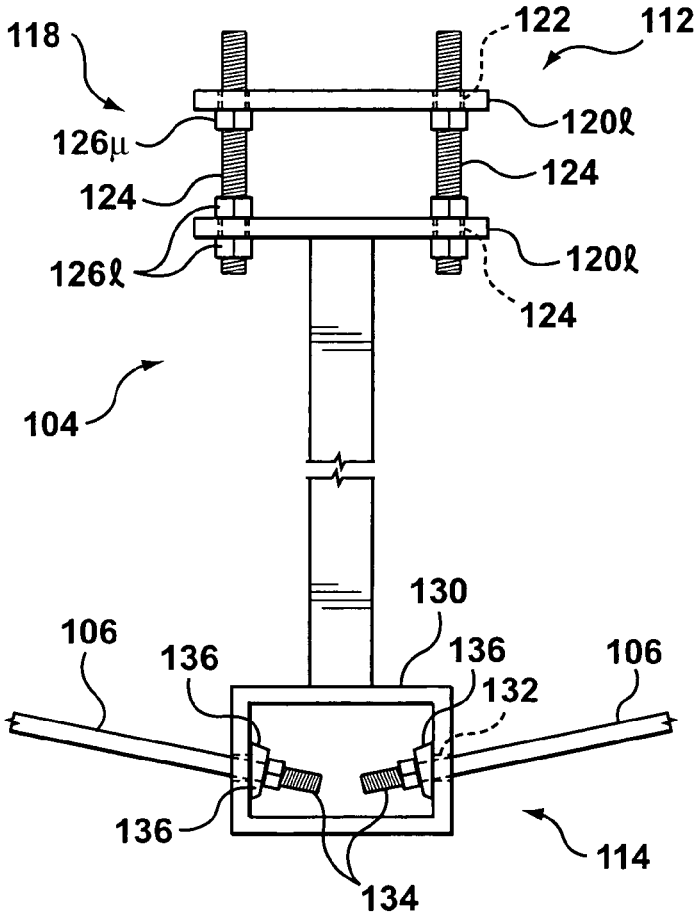
FIGS. 23A and 23B show members of adjustable length for use in the truss of FIG. 22.
Figure 23B:
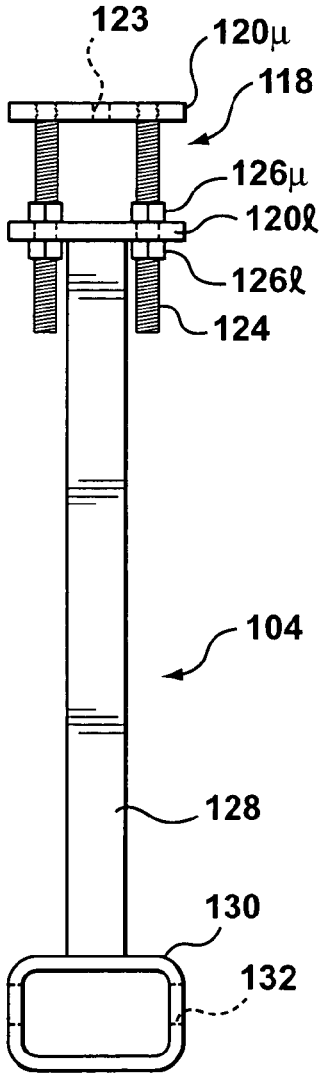

FIGS. 23A and 23B show the adjustable member 104 in greater detail. The adjustable section 118 has two plates 120. At least one plate 120 has a set, for example of four (an additional two are located behind the two shown), clearance holes 122. The adjustable section 118 also has a set of adjusting bolts 124. The adjusting bolts 124 may extend upwards through the upper plate **120*u*, as shown in FIG. 23A, and can be used, in combination with upper nuts 126*u*, to attach the adjustable member 104 to the remainder of the truss 100. Alternately, the adjusting bolts 124 may be welded into or otherwise attached to the upper plate 120*u* and attachment holes 123 provided for attaching the upper plate 120*u* to the remainder of the truss 100 as shown in FIG. 23B. The lower plate 120*l* is located along the adjusting bolts 124 by lower nuts 126*l* on either side of the lower plate 120*l*. By turning the lower nuts 126*l*, the lower plate 120*l* can be moved closer to or further away from the upper plate 120*u* to shorten or lengthen the adjustable member 104**.

The adjustable member 104 also has a compression post 128, made for example of a square aluminum tube, extending from the lower plate **120*l* to the lower end 114 of the adjustable member 104. The lower end 114 has a connection box 130 made, for example, of a section of square aluminum tube. The connection box 130 has a diagonal clearance hole 132 on each side for admitting the diagonals 106. The diagonals have threaded ends 134 which allow the diagonals to be connected to the lower end 114 of the adjustable member 104 with nuts 126 on the inside of the connection box 130. Tapered washers 136 may be used between the nuts 126 and the connection box 130. The threaded ends 134 and nuts 126 allow for some adjustment of the length of the diagonals 106. The length of the diagonals 106 may be made further adjustable by using sections of threaded rods for the diagonals 106 and maintaining a selection of threaded rod segments of different lengths that can be threaded together in different combinations. Other configurations of the truss 100 can also be used. For example, two adjustable members 104 can be used below the cord 102, each connected at its lower end 114 to an end 108 of the cord 102 and to the lower end 114** of the other.

Figure 24A:
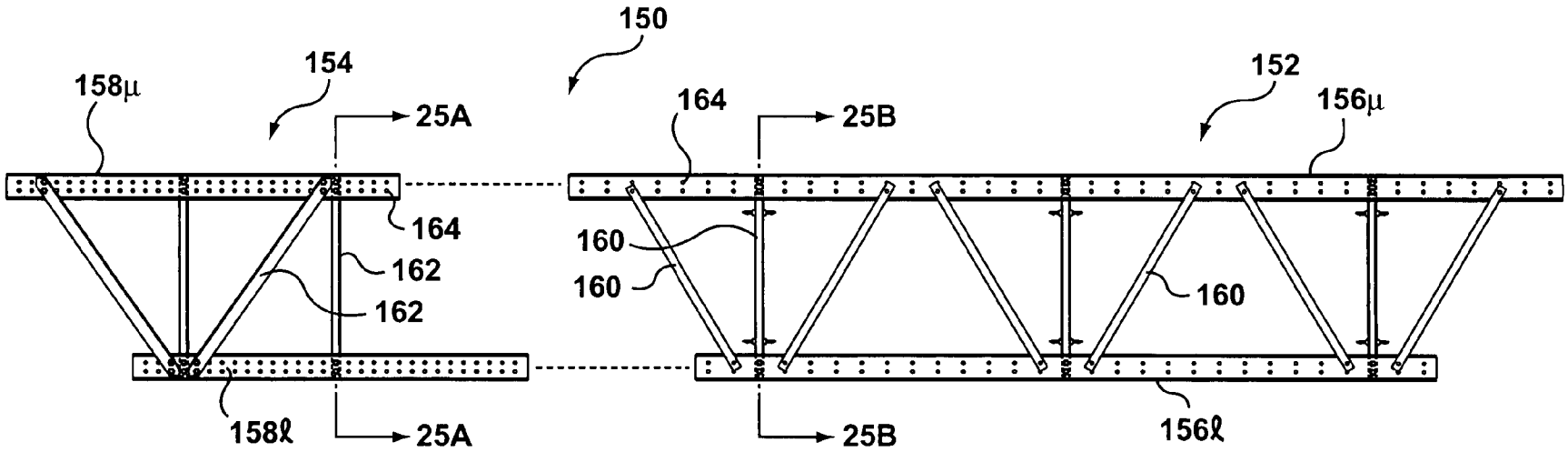
FIG. 24A is an exploded side view of a truss having a first truss section and a second truss section which are unassembled.
Figure 24B:
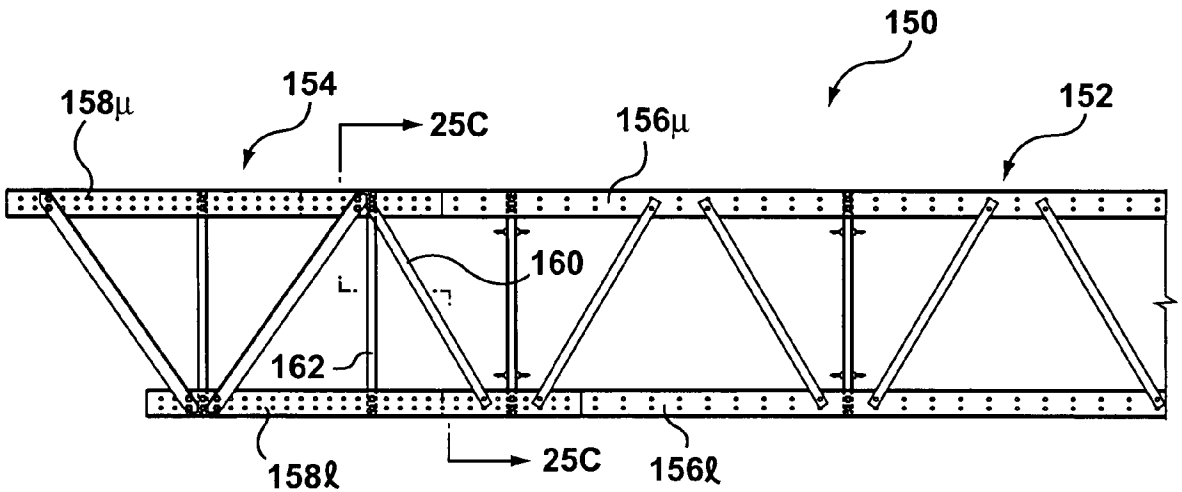
FIG. 24B is a side view of the first and second truss sections of FIG. 24A assembled.

FIGS. 24A and 24B show a third truss 150. The third truss 150 has a first section 152 and a second section 154. In Part A of FIG. 24, the first section 152 and second section 154 are shown separated. In Part B of FIG. 24, the sections 152 and 154 are shown assembled into the third truss 150. The first section 152 has first section upper and lower cords 156*u* and 156*l* made, for example, of aluminum. The second section 154 has second section upper and lower cords 158*u* and 158*l*. First section struts 160 are attached to and extend between the first section cords 156 while second section struts 162 are attached to and extend between the second section cords 158. The struts 160, 162 may be angles or square tubes made, for example, of aluminum. The upper and lower cords of each of the first and second truss sections 152, 154 and first section cords 156 and second section cords 158 are spaced vertically so that they may simultaneously overlap each other. For example, the upper and lower first section cords 156*u*, 156*l* and the upper and lower second section cords 158*u*, 158*l* may have their longitudinal centerlines separated by the same distance.

Assembly holes 164 are provided in the first section cords 156 and second section cords 158. The assembly holes 164 allow the first section 152 and second section 154 to be bolted together with varying lengths of overlap of the first section cords 156 and second section cords 158. In this way, the third truss can be assembled so as to have a variety of spans ranging from the span of the first section 152 to a span equal to the sum of the spans of the first section 152 and the second section 154 less a minimum degree of overlap. The assembly holes 164 may be provided as one or more lines of assembly holes 164 with the assembly holes 164 spaced in each line by a selected interval. For example, the first section cords 156 may have assembly holes 164 spaced six inches apart while the second section cords 158 have assembly holes 164 spaced three inches apart. In this example, the span of the third truss 150 may be varied in three inch increments through the full possible range of spans described above.

Figure 25A:
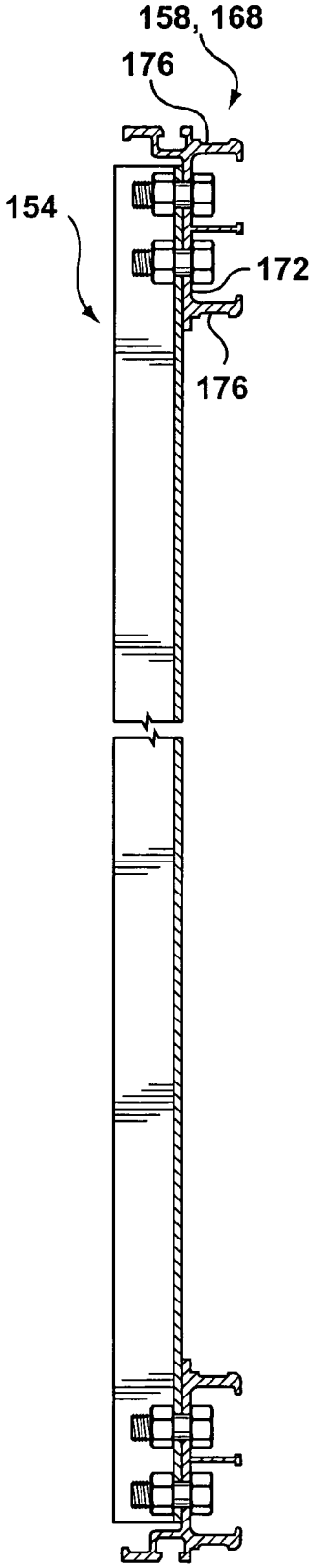
FIGS. 25A, 25B and 25C show section views of the truss of FIGS. 24A and 24B through section lines 25*a*-25*a*, 25*b*-25*b* and 25*c*-25*c*, respectively.
Figure 25B:
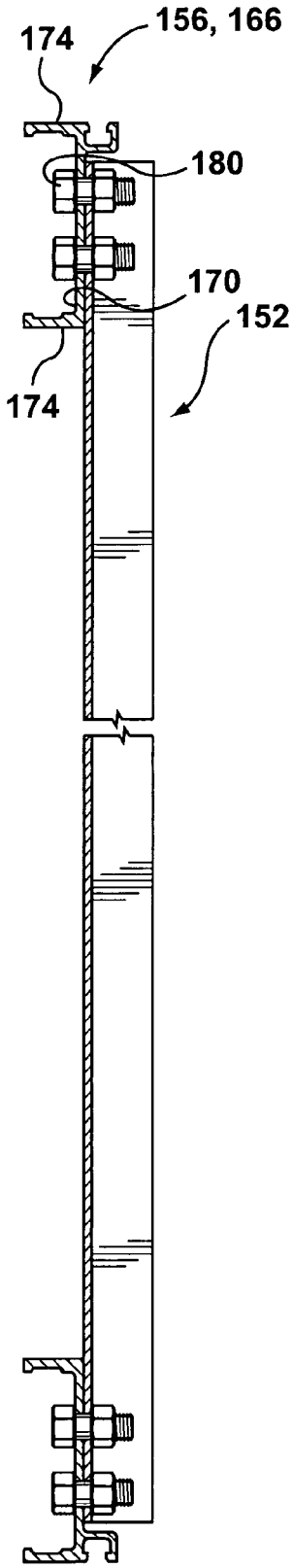
Figure 25C:
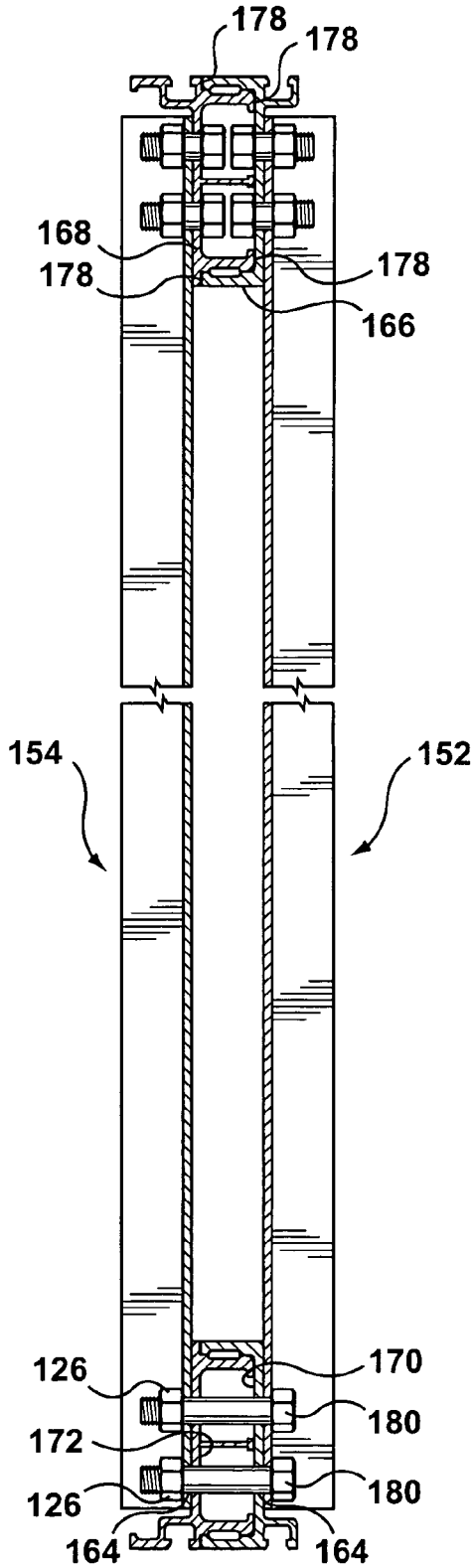

FIGS. 25*a*, 25*b* and 25*c* show sections 25*a*-25*a*, 25*b*-25*b*, and 25*c*-25*c* through the third truss 150 and illustrate the shape of the first section cords 156 and second section cords 158 and how the truss 150 is assembled. The first section cords 156 and second section cords 158 are made of first extrusions 166 and second extrusions 168 respectively. In alternate versions of trusses, the first extrusions 166 may be used for the second section cords 158 and the second extrusions 168 may be used for the first section cords 156.

The extrusions 166, 168 are generally in the shape of C-channels and have first and second webs 170, 172 and first and second flanges 174, 176 respectively. Pairs of extrusions 166, 168 are oriented so that the flanges 174 or 176 of one of the extrusions 166, 168 extends to the left of their web 170 or 172 while the flanges 174 or 176 of the other of the extrusions 166, 168 extends to the right of their web 170 or 172. In this orientation, the second flanges 176 fit inside of the first flanges 174 and the webs 170, 172 remain separated from each other. The separation distance may be made to equal or exceed the thickness of portions of strut attaching bolts 184 or nuts 126 on the flange side of the webs 170, 172. This allows the extrusions 166, 168 to slide along each other even though each has already been assembled into one of the first section 152 or second section 154. The pair of extrusions 166, 168 may be assembled to each other by passing assembly bolts 180 passing through the assembly holes 164, which are drilled through the webs 170, 172, and tightening nuts 126 onto the ends of the bolts.

Figure 26:
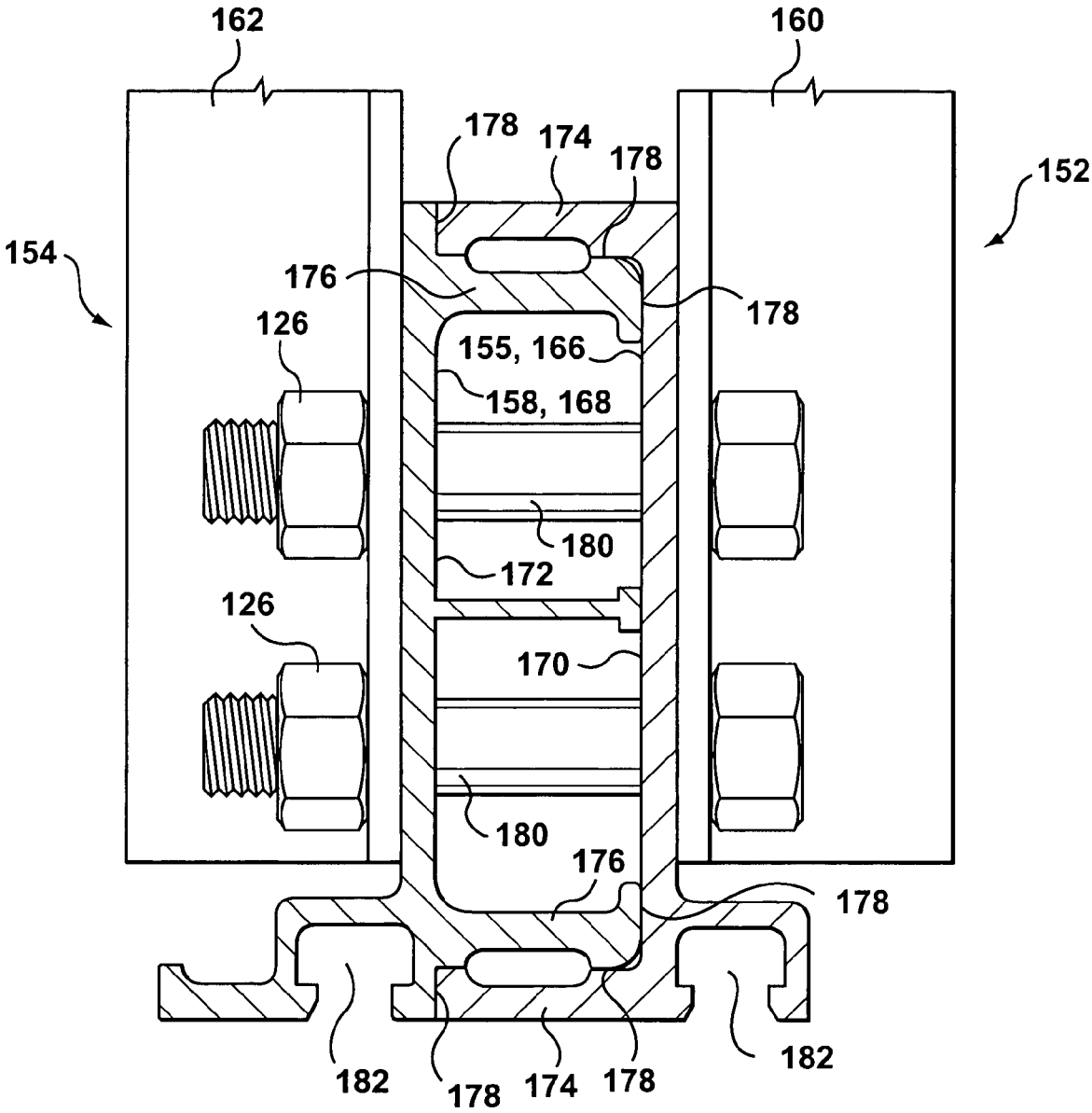
FIG. 26 is an enlarged view of cords of the truss shown in FIG. 25C.

Referring to FIGS. 25*c* and 26, when assembled, the extrusions 166, 168 contact each other at a variety of contact surfaces 178 which extend along the length of overlap between the first section cords 156 and second section cords 158 to assist in aligning the extrusions 166, 168 and transferring forces between them. Contact surfaces 178 on the inside surface of the first flanges 174 and the outside surfaces of the second flanges 176 may be tapered. This allows the extrusions 166, 168 to be roughly aligned before assembly while forcing the extrusions 166, 168 into alignment as the nuts 126 are tightened on the assembly bolts 180. The extrusions 166, 168 may also have one or more auxiliary channels 182 to facilitate attaching other items to the extrusions 166, 168. For example, the auxiliary channels 182 may be sized and shaped to accept the heads of T-bolts used, for further example, to attach strapping between adjacent trusses.

Although the third truss 150 has been described having first and second sections 152, 154, it can also be built with other numbers of sections. For example, a third section may be added to the other side of the first section 152 in a manner like that described for the second section 154. Fourth and fifth sections may also be added to the free ends of the second section 154 and third section and so on.

Figure 27A:
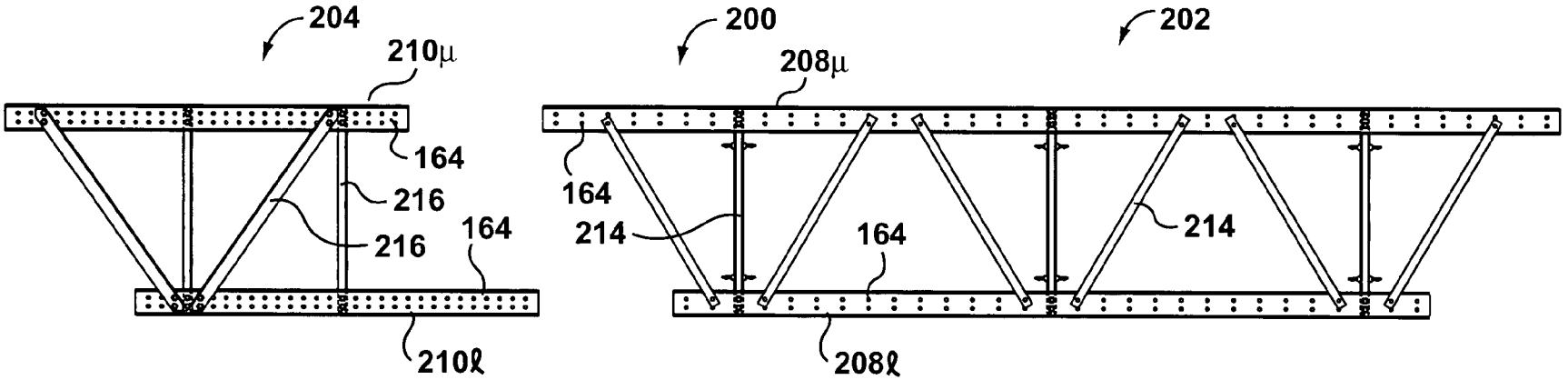
FIGS. 27A and 27B are side views of an alternative embodiment of a truss including first, second and third truss sections and a means to pre-camber the truss.
Figure 27B:
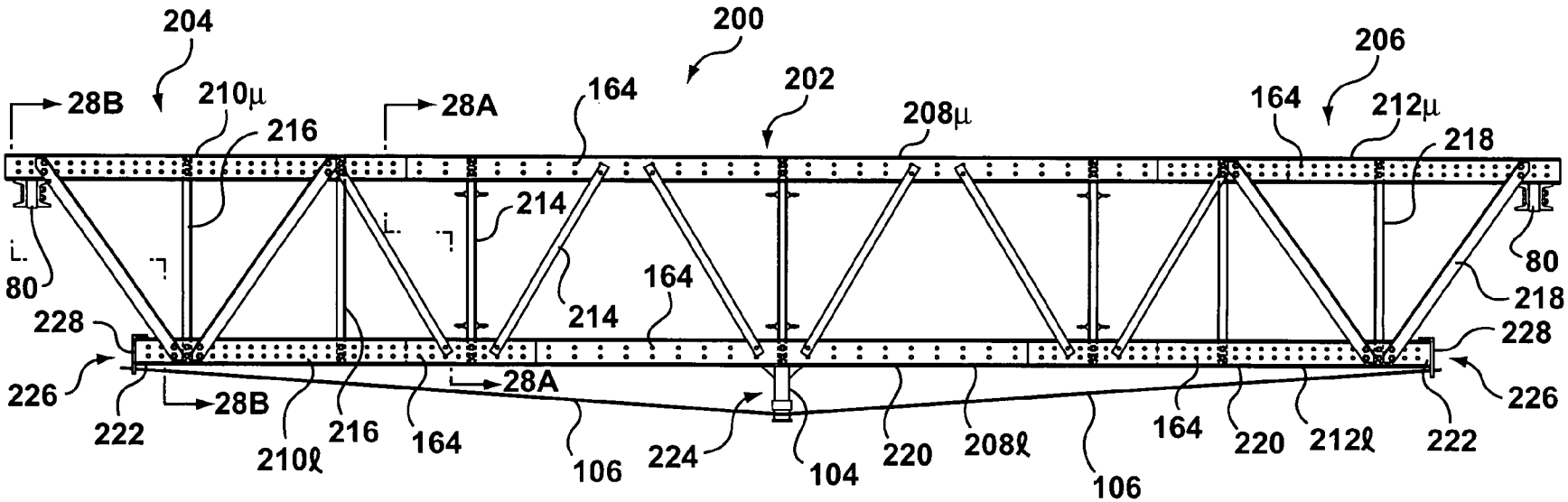

FIGS. 27A and 27B show a fourth truss 200. Although the maximum distance that a truss can span is largely determined by the size and positioning of its members, the fourth truss 200 is typically used to span larger distances than the third truss 150. One advantage of the fourth truss 200 is that it is symmetrical about a vertical plane along its length. The load transferred between the sills or another structure and the fourth truss 200 can also be symmetrical about this plane. Because of this symmetry, eccentric loads are reduced. The fourth truss 200 is also adapted to be fitted with means to provided a pre-camber as were discussed above although the third truss 150 may also be fitted with means to pre-camber it.

The fourth truss 200 has a first truss section 202, a second truss section 204 and a third truss section 206. In Part A of FIG. 27, the first truss section 202 and second truss section 204 are shown separated. The third truss section 206 is not shown but would appear as a mirror image of the second truss section 204 on the other side of the first truss section 202. In Part B of FIG. 27, the truss sections 202, 204 and 206 are shown assembled into the fourth truss 200. The first, second and third truss sections 202, 204, 206 have first, second and third truss section upper and lower cords 208*u*, 208*l*, 210*u*, 210*l*, 212*u* and 212*l* respectively made, for example, of aluminum. First truss section struts 214, made for example of aluminum square tubes, are attached to and extend between the first truss section cords 208. Second and third truss section struts 216 and 218, made for example of aluminum angles, are attached to and extend between the second and third truss section cords 210, 212. The upper and lower cords of each of the first, second and third truss section 202, 204 and 206 are spaced vertically so that they may overlap, for example by having their longitudinal centerlines separated by the same distance.

Assembly holes 164 are provided in the truss section cords 208, 210, 212. As for the third truss 150, the assembly holes allow the truss sections 202, 204, 206 to be bolted together with varying lengths of overlap of the second and third truss section cords 210, 212 relative to the first truss section cords 208. In this way, the fourth truss 200 can be assembled so as to have a variety of spans ranging from the span of the first truss section 202 to a span equal to the sum of the spans of the first, second and third truss sections 202, 204, 206 less twice a minimum degree of overlap between the first truss section 202 and the second or third truss sections 204, 206. The assembly holes 164 may be provided as one or more lines of assembly holes 164 with the assembly holes 164 spaced in each line by a selected interval. For example, the first truss section cords 208 may have assembly holes 164 spaced six inches apart while the second and third truss section cords 210, 212 have assembly holes 164 spaced three inches apart. In this example, the span of the fourth truss 200 may be varied in three inch increments through the full possible range of spans described above.

Figures 1, 28A:
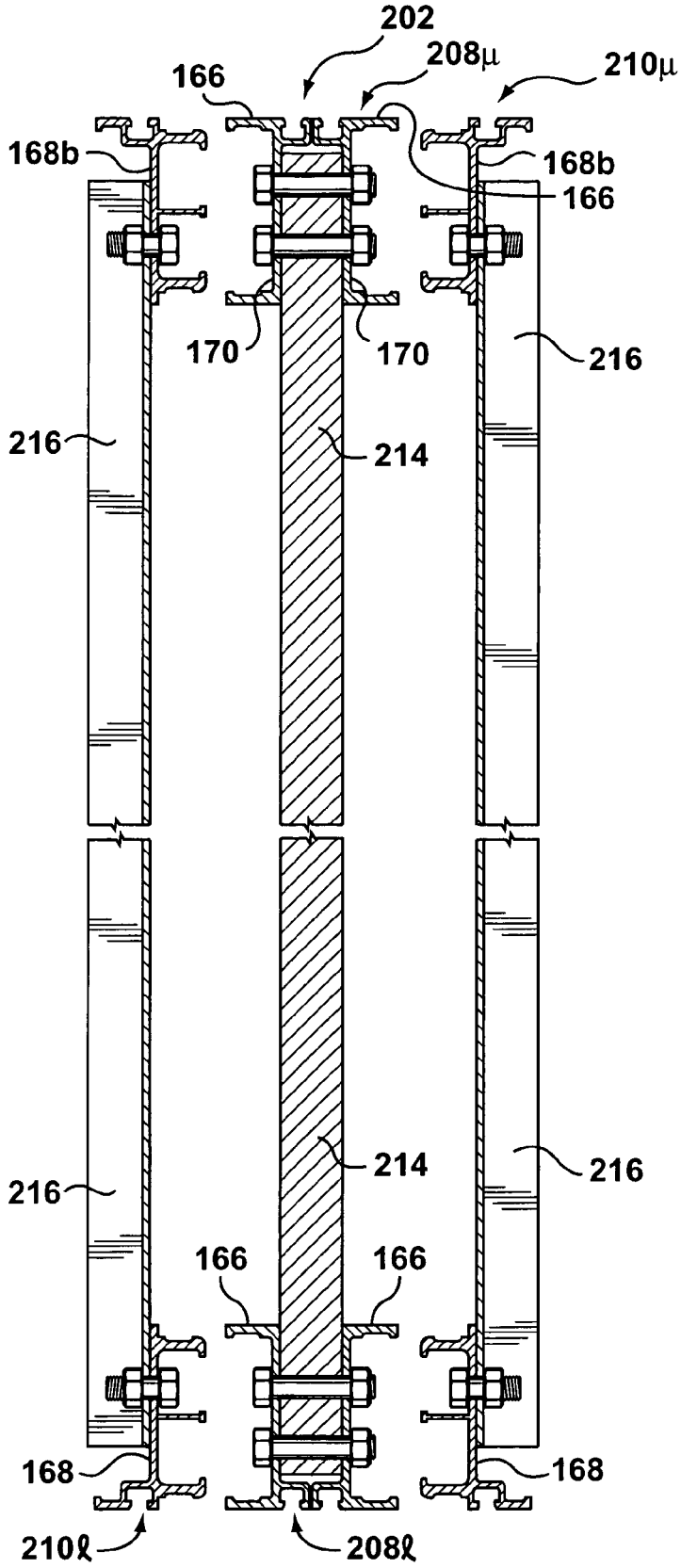
Figures 2, 28A:
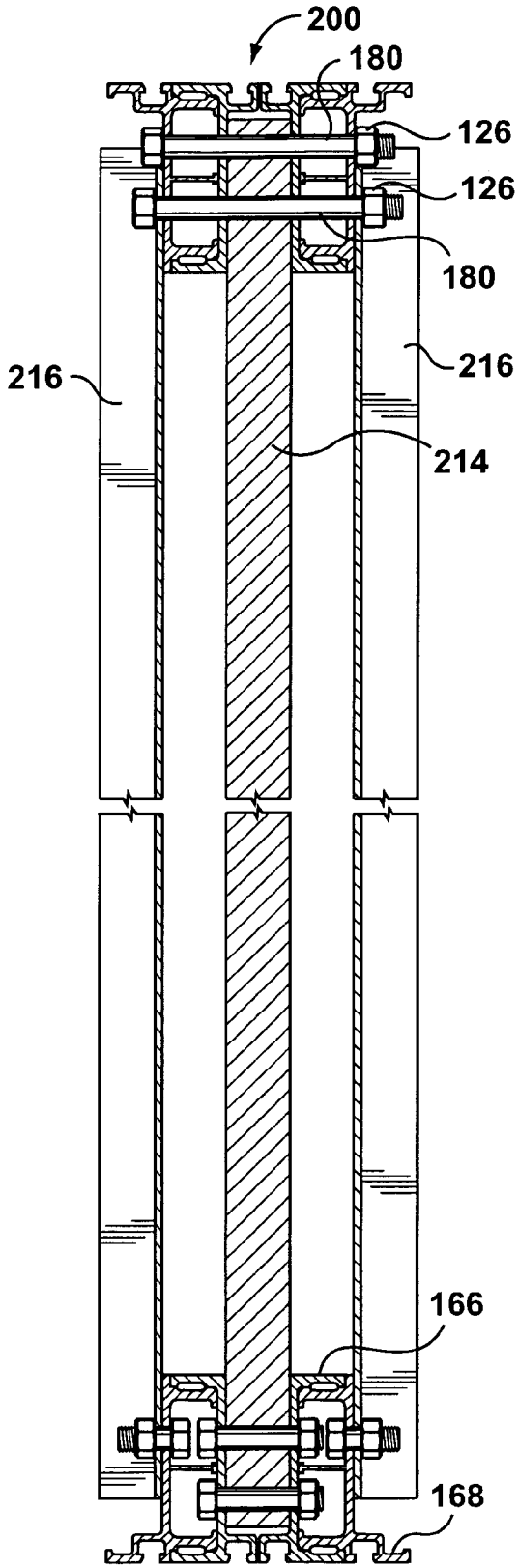
Figure 28B:
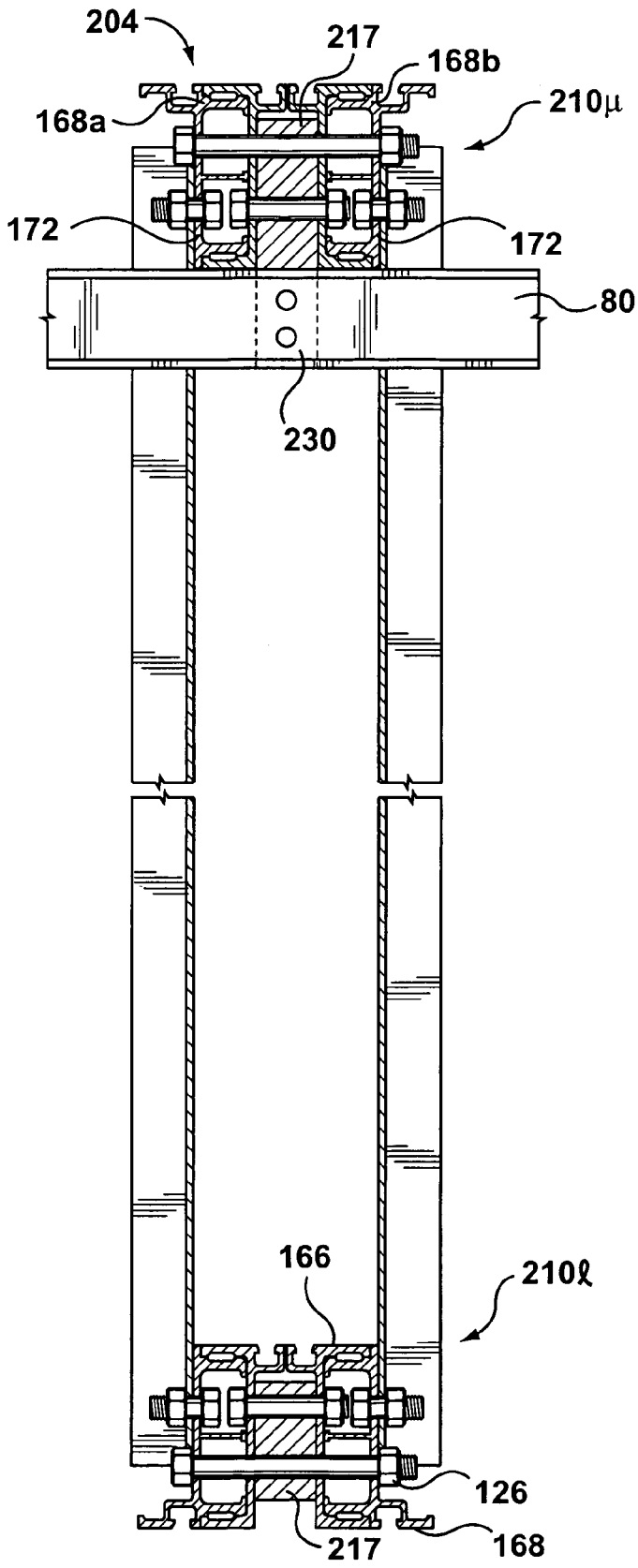
FIG. 28B shows an assembled section view of the truss of FIG. 27B through section line 28*b*-28*b*.
Figures 1, 29A:
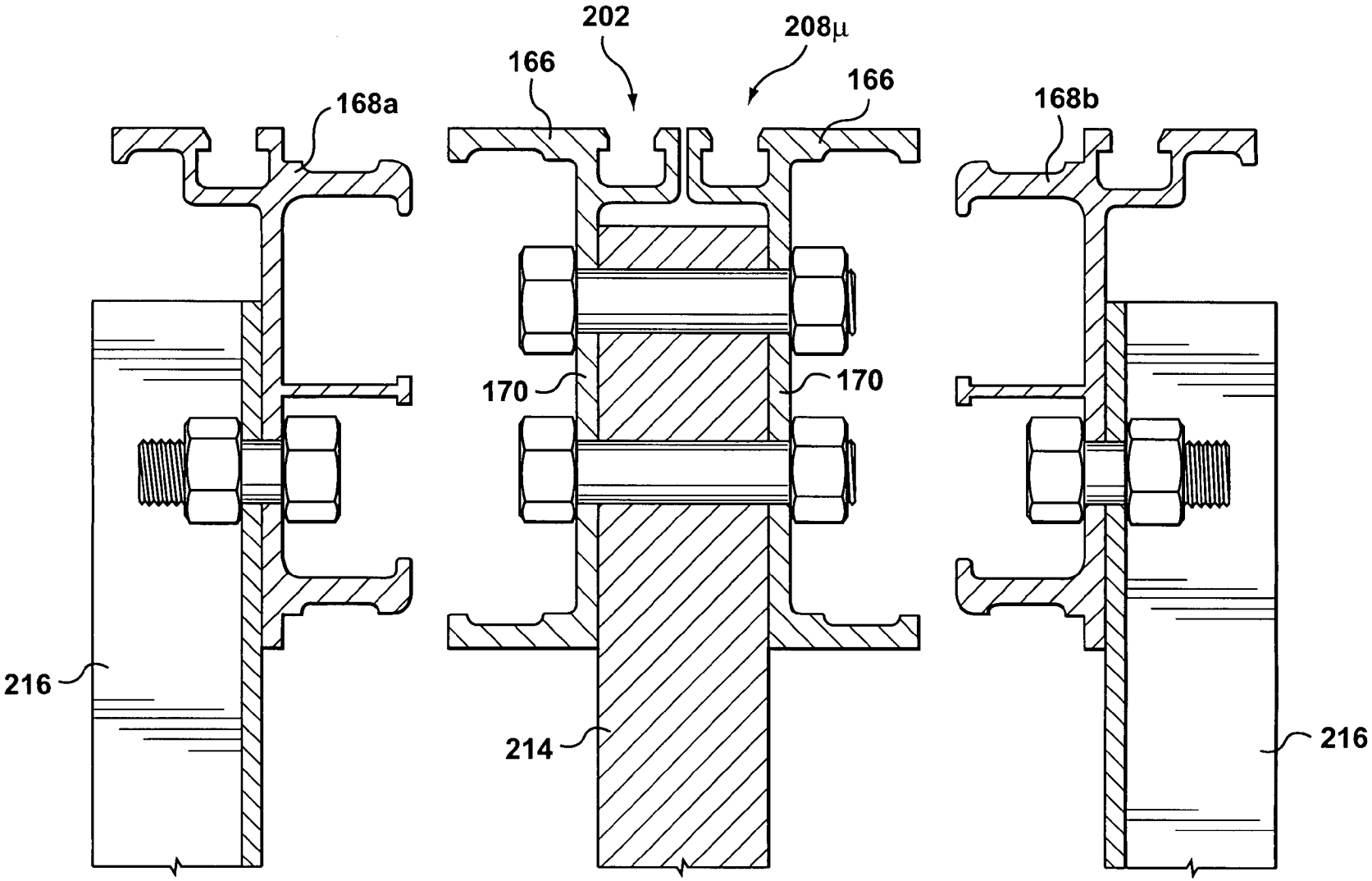
Figures 2, 29A:
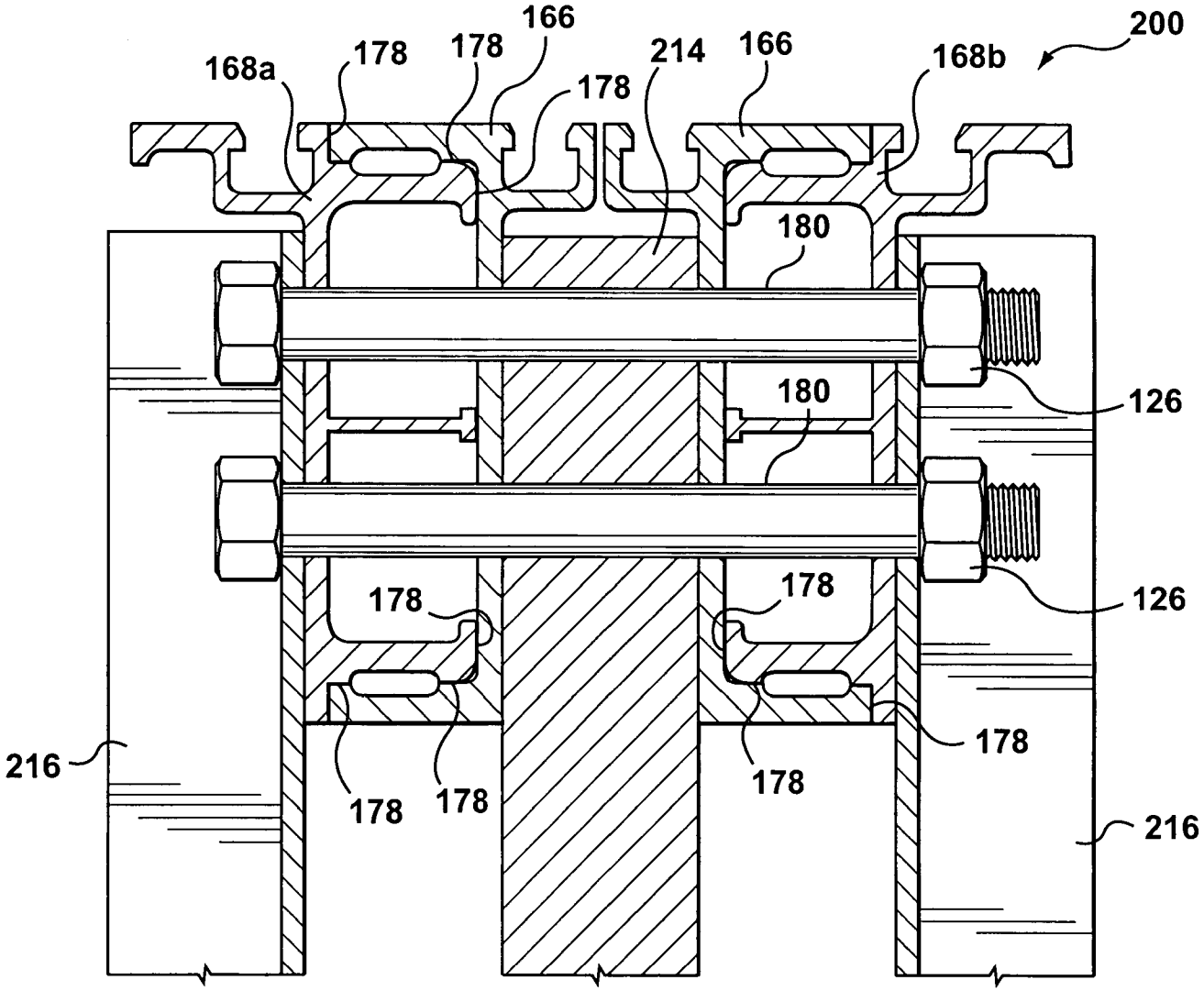
Figure 29B:
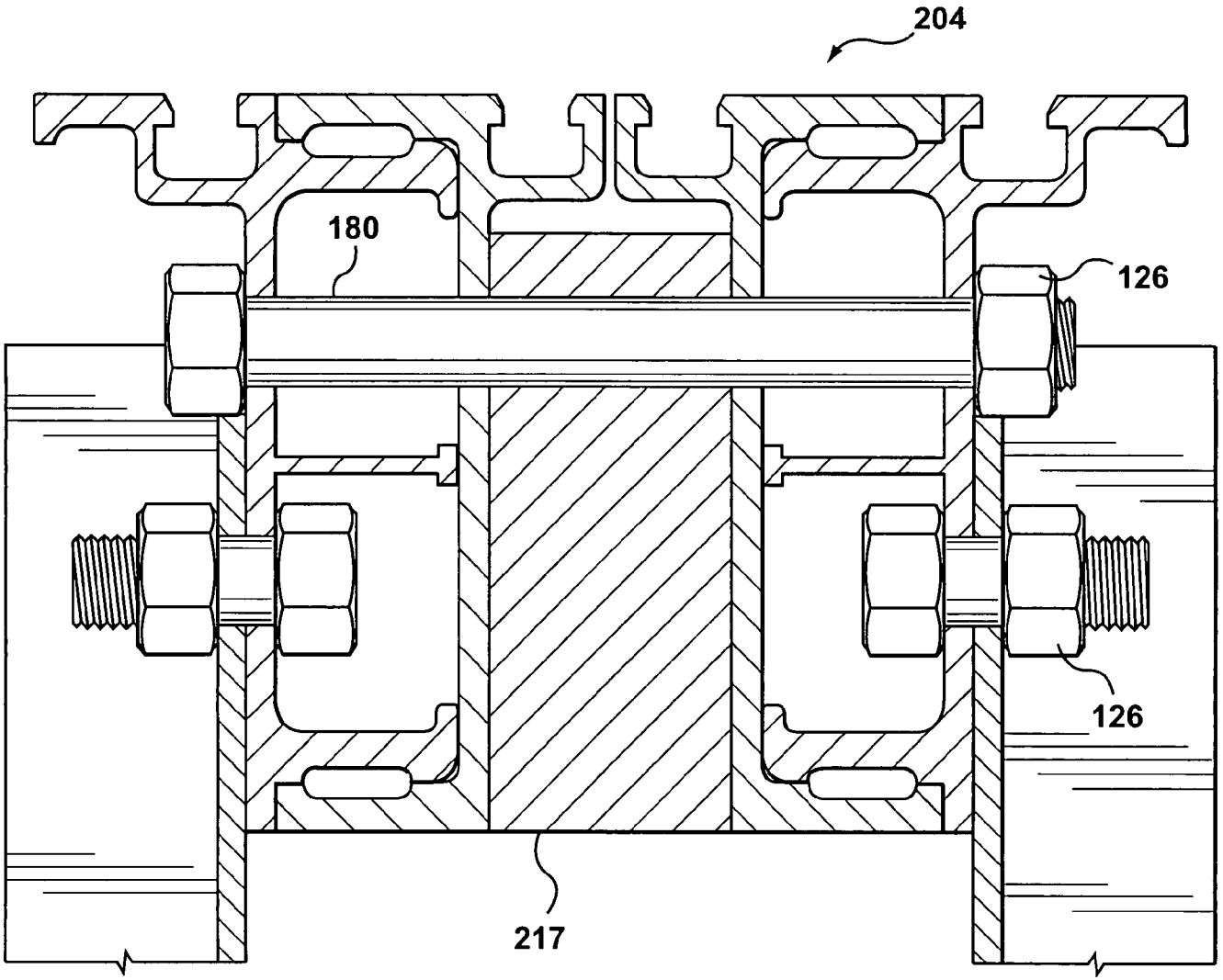

FIGS. 28*a*(1) and 28*a*(2) show exploded and assembled views of section 28*a*-28*a* through the fourth truss 200 and FIG. 28*b* shows an assembled view of section 28*b*-28*b*. FIGS. 29*a*(1), 29*a*(2) and 29*b* show a portion near the upper truss section cords 208*u*, 210*u* shown in each of the views of FIGS. 28*a*(1), 28*a*(2) and 28*b* respectively. The truss section cords 208, 210, 212 are made of a pair of extrusions 166, 168, which are extrusions as described for the third truss 150 above. Referring to FIG. 28*a*(1) the first truss section cords 208 are made of a pair of first extrusions 166 mounted with their first webs 170 to the inside of the first truss sections 202. Referring to FIG. 28*b*, the second truss section cords 210 are made of a pair of second extrusions 168*a*, 168*b* mounted with their second webs 172 to the outside of the second truss section 204. More particularly, in the embodiment illustrated, the second truss section struts 216 comprise pairs of generally parallel angles extending between the upper and lower cords 210*u*, 210*l* of the truss section 204. For each pair of extrusions 168 forming the upper and lower second truss section cords 210 of the second truss section 204, the webs 172 are fastened to opposing faces of the angles 216, so that the second flanges 176 are directed towards each other.

Furthermore, adjacent to the end of the second truss section 204 disposed away from the first truss section 202, spacers 217 can be provided alone or with short lengths of first extrusion 166 as shown between the opposing second extrusions 168 of each of the upper and lower cords 210*u*, 210*l*. The spacers 217 maintain a gap between the second truss section cords 210 to keep them parallel to each other.

The third truss section 206, having upper and lower cords 212*u*, 212*l*, is substantially the same as the second truss section 204. In alternate embodiments, the first extrusions 166 may be used for the second and third truss sections 204, 206 and the second extrusions 168 may be used for the first truss section 202. Pairs of extrusions 166, 168 are assembled generally as described for the third truss 150 but each connection between two truss section cords 208, 210, 212 in the fourth truss 200 involves two pairs of extrusions 166, 168. However, the webs 170, 172 remain separated from each other by a separation distance that allows the extrusions 166, 168 to slide along each other even though each has already been assembled into a truss section 202, 204, 206. The pairs of extrusions 166, 168 may be assembled together by passing assembly bolts 180 through the assembly holes 164 of both pairs of extrusions 166, 168 and tightening nuts 126 onto the ends of the bolts. As described for the third truss 150, the assembled extrusions 166, 168 contact each other at a variety of contact surfaces 178 that assist in aligning the extrusions 166, 168 and transferring forces between them. The extrusions 166, 168 may be roughly aligned before assembly and forced into better alignment by the contact surfaces 178 as the nuts 126 are tightened on the assembly bolts 180. The auxiliary channels 182 may be used, for example, to hold the heads of T-bolts for attaching strapping between adjacent fourth trusses 200.

The fourth truss 200 may optionally be fitted with means for pre-cambering the fourth truss 200 similar to the means described for the second truss 100. Referring back to FIG. 27B, the fourth truss 200 has an adjustable member 104 and a pair of diagonal members 106. The lower truss section cords 208*l*, 210*l*, 212*l* form, when assembled together, a composite cord 220 having two composite cord ends 222 and a composite cord middle 224. The upper end 112 of the adjustable member 104 is attached to the lower first truss section cord 208*l* about or close to its middle. When the span of the fourth truss 200 is altered, the second and third truss sections 204, 206 may be assembled to the first truss section 202 with amounts of overlap that differ by no more than the interval between the assembly holes 164. In this way, the adjustable member 104 may be kept within one half of the interval between the assembly holes 164 to the composite cord middle 224 without moving the adjustable member 104.

Figure 30A:
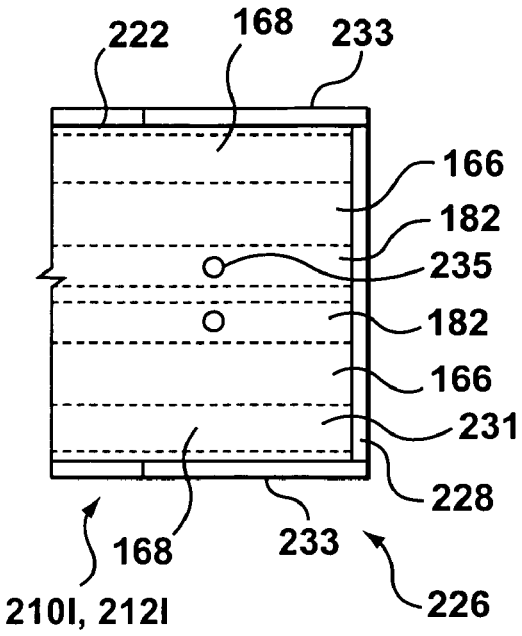
FIG. 30A is a plan view of a connection between an end of a lower cord of the truss of FIG. 27B and the means to pre-camber the truss using an end plate, shown in side elevation in FIG. 30B.
Figure 30B:
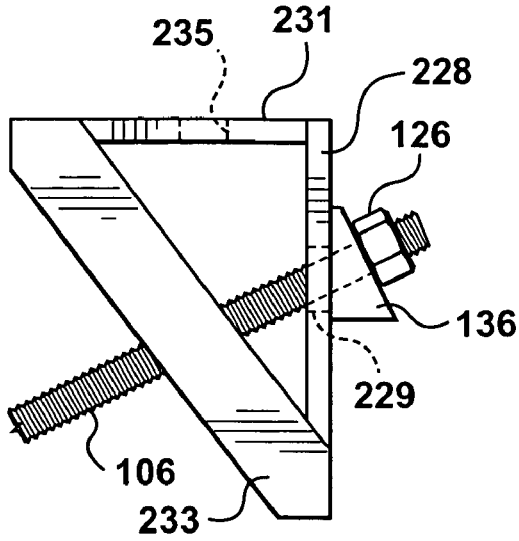

The adjustable member 104 is oriented generally vertically and with its lower end 114 below the lower first truss section cord 208*l*. Each diagonal member 106 is connected between the lower end 114 of the adjustable member 104 and a fourth end connection 226 at a composite cord end 222. The fourth end connections 226 are shown in greater detail in FIGS. 30A and 30B. Short sections of the first extrusion 166 are bolted to the ends of lower second and third truss section cords 210*l*, 212*l* at the composite cord ends 222. The sections of first extrusion 166 are installed with the auxiliary channels 182 opening upwards which is possible because the extrusions 166, 168 are symmetrical about their longitudinal axes. An end plate 228, shown in FIG. 30B, is bolted to the auxiliary channels 182 through end plate top holes 235 and has an end plate hole 229 to accept a diagonal 106. The end plate 228 has a top 231 and sides 233. A nut 126 is threaded onto the end of the diagonal 106 and bears against the end plate 228. The end plate 228 may be vertical and tapered washers 136 may be used between the nut 126 and the diagonal plate 228 to provide a flat contact surface against which the nut 126 may bear. In addition to being part of the connection to the diagonals 106, the end plate 228 also spaces apart the distal ends of the lower second and third truss section cords 210*l*, 212*l* because of the connection between the top 231 and the auxiliary channels 182. In some embodiments, the end plate 228 may perform the function of the spacer 217 described above although a spacer 217 may also be added between the inner extrusions.

Figure 31:
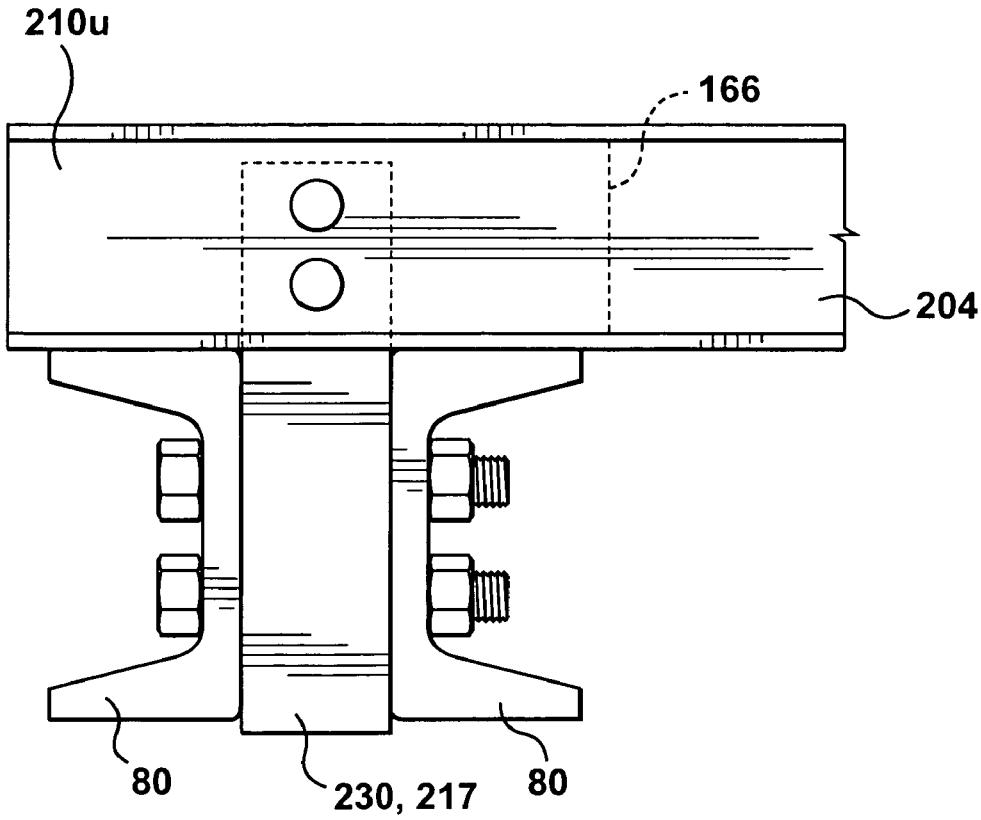
FIG. 31 is a view of an end of an upper cord of the truss of FIG. 27B connected to a sill beam.

FIG. 31 shows in greater detail a connection between the fourth truss 200 and a sill beam 80 spanning, for example, across a line of shoring brackets. The connection is also seen in FIGS. 27 Part B and 28*b*. To make the connection, the distal ends of the upper second or third truss section cords 210*u*, 212*u* are fitted with sections of first extrusion 166. A spacer 217, elongated to form a connecting post 230, and which may be a short section of the first truss section strut

214 material, is bolted in place between the first extrusions 166. The connecting post 230 extends downwards and is bolted into the sill beam 80 which may also be made of a spaced pair of extrusions, for example of aluminum. In addition to being part of the connection with the sill beam 80, the connecting post 230 and sections of first extrusion 166 also space apart the distal ends of the upper second or third truss section cords 210*u*, 212*u*. Optionally, a sill truss may be used in place of the sill beam 80 in situations where a longer distance between shoring brackets 10 must be spanned. When a sill truss is used, the connection shown in FIG. 31 may be made to a top cord of the sill truss which can be made in the same configuration as the sill beam.

Figure 32:
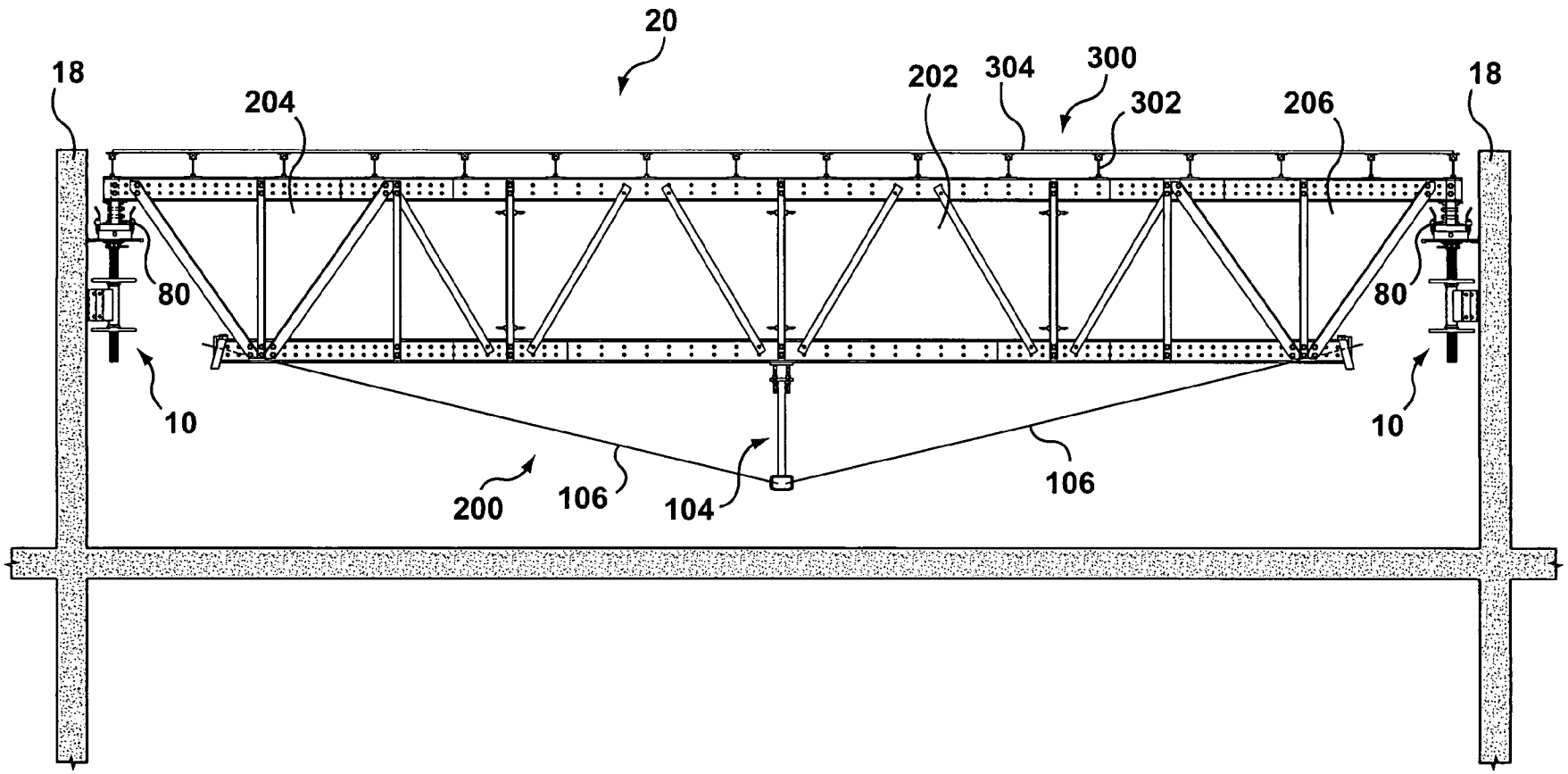
FIG. 32 is a side elevation of a shoring apparatus comprising an assembly of devices shown in other Figures.

FIG. 32 shows an example of part of an installed shoring system. Shoring brackets 10 are mounted to columns 18 of a building. The shoring brackets 10 support a form 20. The form 20 includes sill beams 80, or sill trusses, which in turn support spanning members such as fourth trusses 200. Typically, there are a plurality of parallel spanning members provided with a generally regular spacing between them. Alternately, shoring brackets 10 may support the spanning members directly without an intervening sill. The form 20 also includes a form deck 300, typical located on top of the spanning members. For example, form deck 300 may have a series of joists 302 running generally perpendicular to the spanning members and a floor 304 located on the joists 302. To make a floor, concrete is poured onto the floor 304 with reinforcing in the concrete as required. Other forms 20 may be used to create other structures.

Other embodiments of the invention may be made in other configurations and operated according to other methods within the scope of the invention. The scope of the invention is defined by the following claims.

We claim:

1. A truss for spanning between supports in a shoring system comprising, (a) a first truss section having first and second ends and comprising, i. one or more truss members forming a first generally horizontal cord having a middle and a pair of opposed ends;

ii. one or more truss members forming a second generally horizontal cord generally parallel to and above the first generally horizontal cord; and, iii. a plurality of struts between the first generally horizontal cord and the second generally horizontal cord;

b) a second truss section having second section upper and lower generally horizontal cords separated by second section struts, the second truss section having first and second ends, the first end of the second truss section connected to the first end of the first truss section;

c) a third truss section having third section upper and lower generally horizontal cords separated by third section struts, the third truss section having first and second ends, the first end of the third truss section connected to the second end of the first truss section;

d) a pair of diagonal members having first and second ends; and, e) an adjustable member oriented generally vertically and having an upper end and a lower end, wherein, f) the upper end of the adjustable member is connected to the middle of the first generally horizontal cord;

g) the lower end of the adjustable member is connected to a first end of each of the diagonal members;

h) the second ends of the diagonal members are connected one to each of the second end of the second truss section and the second end of the third truss section; and, i) the second and third truss sections are attachable to the first truss section in a plurality of locations such that the truss may be assembled in a plurality of widths.

2. A truss for spanning between an opposed pair of supports in a shoring system, the truss comprising, a) a first truss section having first section upper and lower generally horizontal cords separated by first section struts;

b) a second truss section having second section upper and lower generally horizontal cords separated by second section struts, wherein, c) the cords each have a web and flanges;

d) the first section upper cord and the second section upper cord form an upper pair of cords;

e) the first section lower cord and the second section lower cord form a lower pair of cords;

f) the pairs of cords are slidable along and relative to each other along the longitudinal axes of the cords; and, g) the webs of the cords of each pair of cords are spaced apart from each other by the flanges of a cord, h) the cords of each pair of cords are generally in the shape of C-channels having webs and flanges oriented such that the flanges of the cord of one of the pair extend to the left and the flanges of the other cord of the pair extend to the right of the web and the struts are bolted to the webs.

3. The truss of claim 2 wherein the truss further comprises, a) a pair of diagonal members having first and second ends, wherein, b) the adjustable member is oriented generally vertically and has an upper end and a lower end;

c) the upper end of the adjustable member is connected to the middle of the lower cord of the truss;

d) the lower end of the adjustable member is connected to the first end of each of the diagonal members; and, e) the second ends of the diagonal members are connected one to each of the distal ends of the truss sections.

4. The truss of claim 2 wherein the cords of each pair of cords have a plurality of engaging surfaces for engaging each other.

5. The truss of claim 2 wherein the cords are shaped such that the cords may be initially put together in a rough alignment but bolting the pair of cords together draws them into a more nearly co-linear alignment.

6. A truss for spanning between an opposed pair of supports in a shoring system, the truss comprising, a) a first truss section having first section upper and lower generally horizontal cords separated by first section struts;

b) a second truss section having second section upper and lower generally horizontal cords separated by second section struts, wherein, c) the cords each have a web and flanges;

d) the first section upper cord and the second section upper cord form an upper pair of cords;

e) the first section lower cord and the second section lower cord form a lower pair of cords;

f) the pairs of cords are slidable along and relative to each other along the longitudal axes of the cords;

g) the webs of the cords of each pair of cords are spaced apart from each other by the flanges of a cord; and, h) the cords of at least one of the cords of the first truss section or the second truss section are provided with one or more lines of holes, the holes being spaced horizontally in each line of holes by a selected increment and extending from near the end of the truss section to beyond a first one of the struts and wherein at least one matching hole is provided in the other truss section, such that the truss sections may be bolted together to provide a plurality of spans differing by the selected increment.

7. The truss of claim 6 further comprising a third truss section having third section upper and lower generally horizontal cords separated by third section struts, wherein the third section upper and lower cords can be attached to second ends of the first section upper and lower cords in a plurality of locations such that the truss may be assembled in a plurality of widths.

8. The truss of claim 6 having at least one adjustable member with an adjustable length, wherein adjusting the length of the adjustable member causes the truss to become pre-cambered.

9. A truss for spanning between an opposed pair of supports in a shoring system, the truss comprising, a) a first truss section having first section upper and lower generally horizontal cords separated by first section struts;

b) a second truss section having second section upper and lower generally horizontal cords separated by second section struts, wherein, c) the cords each have a web and flanges;

d) the first section upper cord and the second section upper cord form an upper pair of cords;

e) the first section lower cord and the second section lower cord form a lower pair of cords;

f) the pairs of cords are slidable along and relative to each other along the longitudinal axes of the cords;

g) the webs of the cords of each pair of cords are spaced apart from each other by the flanges of a cord; and, h) the struts are attached to the webs of the cords of their respective truss sections with bolts and the webs of the cords of each pair of cords are spaced apart from each other by a separation distance such that the pairs of cords may slide relative to each other without the heads of the bolts associated with either of the first or second truss section contacting the heads of the bolts associated with the other truss section.

10. The truss of claim 9 wherein the cords of at least one of the first truss section or the second truss section are provided with one or more lines of holes, the holes being spaced horizontally in each line of holes by a selected increment and extending from near the end of the truss section to beyond a first one of the struts and wherein at least one matching hole is provided in the other truss section, such that the truss sections may be bolted together to provide a plurality of spans differing by the selected increment.

* * * * *